US007916134B2

(12) United States Patent
Morita

(10) Patent No.: US 7,916,134 B2
(45) **Date of Patent: *Mar. 29, 2011**

(54) POWER SUPPLY METHOD AND POWER SUPPLY CIRCUIT

(75) Inventor: Akira Morita, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 756 days.

This patent is subject to a terminal disclaimer.

(21) Appl. No.: 11/852,869

(22) Filed: Sep. 10, 2007

(65) Prior Publication Data

US 2008/0186297 A1 Aug. 7, 2008

Related U.S. Application Data

(62) Division of application No. 10/726,006, filed on Dec. 2, 2003, now Pat. No. 7,286,125.

(30) Foreign Application Priority Data

Dec. 5, 2002 (JP) ..... 2002-353795

(51) Int. Cl.
*G09G 5/00* (2006.01)

(52) U.S. Cl. ..... 345/212; 345/87; 345/100; 345/211; 345/213

(58) Field of Classification Search ..... 345/204–215, 345/87–101
See application file for complete search history.

(56) References Cited

U.S. PATENT DOCUMENTS 6,157,358 A * 12/2000 Nakajima et al. ..... 345/96
6,229,512 B1 * 5/2001 Shigehiro ..... 345/98
6,441,758 B1 * 8/2002 Koyama et al. ..... 341/136
6,784,866 B2 8/2004 Udo et al. ..... 345/100

FOREIGN PATENT DOCUMENTS

JP 2002-023709 1/2002

* cited by examiner

*Primary Examiner* — Vijay Shankar
(74) *Attorney, Agent, or Firm* — DLA Piper LLP (US)

(57) ABSTRACT

A power supply method of supplying a high-potential drive power voltage to a data line driver circuit which drives a plurality of data lines in a display panel which has a plurality of pixels and a plurality of scanning lines in addition to the data lines. An output from the data line driver circuit to the data lines is set to a high-impedance state, and a charge corresponding to a charge discharged from the data lines is accumulated in a parasitic capacitor of a power line of a regulator which outputs a drive power voltage to be supplied to the data line driver circuit, within a given period. After the period, a voltage generated by the charge accumulated in the parasitic capacitor is output to the power line, and a voltage generated by the regulator is supplied to the data line driver circuit as the high-potential drive power voltage for the data line driver circuit.

5 Claims, 17 Drawing Sheets

POWER SUPPLY METHOD AND POWER SUPPLY CIRCUIT

This application is a divisional of application Ser. No. 10/726,006 filed Dec. 2, 2003, the entire contents of which are incorporated by reference. This application also claims benefit of priority under 35 USC §119 to Japanese Patent Application No. 2002-353795 filed on Dec. 5, 2002, is hereby incorporated by reference in its entirety.

BACKGROUND OF THE INVENTION

The present invention relates to a power supply method and a power supply circuit.

As a liquid crystal panel (display panel in a broad sense) used for an electronic instrument such as a portable telephone, a simple matrix type liquid crystal panel and an active matrix type liquid crystal panel using switching elements such as thin film transistors (hereinafter abbreviated as "TFTs") have been known.

The simple matrix method enables power consumption to be reduced in comparison with the active matrix method. However, it is difficult to increase the number of colors and to display a moving image by using the simple matrix method. The active matrix method is suitable for increasing the number of colors and displaying a moving image. However, it is difficult to reduce power consumption by using the active matrix method.

In recent years, an increase in the number of colors and display of a moving image have been demanded for a portable electronic instrument such as a portable telephone in order to provide a high-quality image. Therefore, an active matrix type liquid crystal panel has been used instead of a conventionally used simple matrix type liquid crystal panel.

BRIEF SUMMARY OF THE INVENTION

According to a first aspect of the present invention, there is provided a power supply method of supplying a high-potential drive power voltage to a driver circuit which receives a low-potential drive power voltage in addition to the high-potential drive power voltage and drives a plurality of data lines in a display panel which has a plurality of pixels and a plurality of scanning lines in addition to the data lines, the method comprising:

setting an output from the driver circuit to the data lines to a high-impedance state, and accumulating a charge corresponding to a charge discharged from the data lines in a parasitic capacitor of a power line of a regulator which outputs a drive power voltage to be supplied to the driver circuit, within a given period; and outputting a voltage generated by the charge accumulated in the parasitic capacitor to the power line, and supplying a voltage generated by the regulator to the driver circuit as the high-potential drive power voltage for the driver circuit, after the period.

According to a second aspect of the present invention, there is provided a power supply method of supplying a high-potential drive power voltage to a driver circuit which receives a low-potential drive power voltage in addition to the high-potential drive power voltage and drives a plurality of data lines in a display panel which has a plurality of pixels and a plurality of scanning lines in addition to the data lines, the method comprising:

setting an output from the driver circuit to the data lines to a high-impedance state, and accumulating a charge corresponding to a charge discharged from the data lines in a capacitor, one end of which is connected directly or through a specific component to a power line of a regulator which outputs a drive power voltage to be supplied to the driver circuit, within a given period; and outputting a voltage generated by the charge accumulated in the capacitor to the power line, and supplying a voltage generated by the regulator to the driver circuit as the high-potential drive power voltage for the driver circuit, after the period.

According to a third aspect of the present invention, there is provided a power supply method of supplying a high-potential drive power voltage to a driver circuit which receives a low-potential drive power voltage in addition to the high-potential drive power voltage and drives a plurality of data lines in a display panel which has in addition to the data lines through each of which multiplexed data signals for first to third color components are transmitted:

a plurality of scanning lines;

a plurality of pixels, each of which is connected to one of the scanning lines and one of the data lines; and a plurality of demultiplexers, each of which includes first to third demultiplexing switch elements respectively controlled by first to third demultiplex control signals, one end of each of the demultiplexing switch elements being connected to one of the data lines, and the other end of each of the demultiplexing switch elements being connected to a pixels for the j-th color component ($1 \leqq j \leqq 3$, j is an integer) among the pixels, the method comprising:

setting an output from the driver circuit to the data lines to a high-impedance state, setting the first to third demultiplexing switch elements to an ON state by using the first to third demultiplex control signals, and accumulating a charge corresponding to a charge discharged from the data lines in a parasitic capacitor of a power line of a regulator which outputs a drive power voltage to be supplied to the driver circuit, within a given period; and outputting a voltage generated by the charge accumulated in the parasitic capacitor to the power line, and supplying a voltage generated by the regulator to the driver circuit as the high-potential drive power voltage for the driver circuit, after the period.

According to a fourth aspect of the present invention, there is provided a power supply method of supplying a high-potential drive power voltage to a driver circuit which receives a low-potential drive power voltage in addition to the high-potential drive power voltage and drives a plurality of data lines in a display panel which has in addition to the data lines through each of which multiplexed data signals for first to third color components are transmitted:

a plurality of scanning lines;

a plurality of pixels, each of which is connected to one of the scanning lines and one of the data lines; and a plurality of demultiplexers, each of which includes first to third demultiplexing switch elements respectively controlled by first to third demultiplex control signals, one end of each of the demultiplexing switch elements being connected to one of the data lines, and the other end of each of the demultiplexing switch elements being connected to a pixels for the j-th color component ($1 \leqq j \leqq 3$, j is an integer) among the pixels, the method comprising:

setting an output from the driver circuit to the data lines to a high-impedance state, setting the first to third demultiplexing switch elements to an ON state by using the first to third demultiplex control signals, and accumulating a charge corresponding to a charge discharged from the data lines in a capacitor, one end of which is connected directly or through a specific component to a power line of a regulator which outputs a drive power voltage to be supplied to the driver circuit, within a given period; and outputting a voltage generated by the charge accumulated in the capacitor to the power line, and supplying a voltage generated by the regulator to the driver circuit as the high-potential drive power voltage for the driver circuit, after the period.

According to a fifth aspect of the present invention, there is provided a power supply method of supplying a negative voltage to a driver circuit which receives high-potential and low-potential drive power voltages and drives a plurality of data lines in a display panel which has a plurality of pixels and a plurality of scanning lines in addition to the data lines, by utilizing a charge from a low-potential power line through which the low-potential drive power voltage is supplied, the method comprising:

setting an output from the driver circuit to the data lines to a high-impedance state, and accumulating a charge corresponding to a charge discharged from the data lines in a parasitic capacitor of the low-potential power line connected to a regulator which outputs the negative voltage, within a given period; and outputting the negative voltage generated by the regulator based on a voltage generated by the charge accumulated in the parasitic capacitor, as the low-potential drive power voltage, after the period.

According to a sixth aspect of the present invention, there is provided a power supply method of supplying a negative voltage to a driver circuit which receives high-potential and low-potential drive power voltages and drives a plurality of data lines in a display panel which has a plurality of pixels and a plurality of scanning lines in addition to the data lines, by utilizing a charge from a low-potential power line through which the low-potential drive power voltage is supplied, the method comprising:

setting an output from the driver circuit to the data lines to a high-impedance state, and accumulating a charge corresponding to a charge discharged from the data lines in a capacitor, one end of which is connected directly or through a specific component to the low-potential power line connected to a regulator which outputs the negative voltage, within a given period; and outputting the negative voltage generated by the regulator based on a voltage generated by the charge accumulated in the capacitor, as the low-potential drive power voltage, after the period.

According to a seventh aspect of the present invention, there is provided a power supply method of supplying a negative voltage by utilizing a charge from a low-potential power line through which a low-potential drive power voltage is supplied, to a driver circuit which receives a high-potential drive power voltage in addition to the low-potential drive power voltage and drives a plurality of data lines in a display panel which has in addition to the data lines through each of which multiplexed data signals for first to third color components are transmitted:

a plurality of scanning lines;

a plurality of pixels, each of which is connected to one of the scanning lines and one of the data lines, and a plurality of demultiplexers, each of which includes first to third demultiplexing switch elements respectively controlled by first to third demultiplex control signals, one end of each of the demultiplexing switch elements being connected to one of the data lines, and the other end of each of the demultiplexing switch elements being connected to a pixels for the j-th color component ($1 \leqq j \leqq 3$, j is an integer) among the pixels, the method comprising:

setting an output from the driver circuit to the data lines to a high-impedance state, setting the first to third demultiplexing switch elements to an ON state by using the first to third demultiplex control signals, and accumulating a charge corresponding to a charge discharged from the data lines in a parasitic capacitor of the low-potential power line connected to a regulator which outputs the negative voltage, within a given period; and outputting the negative voltage generated by the regulator based on a voltage generated by the charge accumulated in the parasitic capacitor, as the low-potential drive power voltage, after the period.

According to an eighth aspect of the present invention, there is provided a power supply method of supplying a negative voltage by utilizing a charge from a low-potential power line through which a low-potential drive power voltage is supplied, to a driver circuit which receives a high-potential drive power voltage in addition to the low-potential drive power voltage and drives a plurality of data lines in a display panel which has in addition to the data lines through each of which multiplexed data signals for first to third color components are transmitted:

a plurality of scanning lines;

a plurality of pixels, each of which is connected to one of the scanning lines and one of the data lines; and a plurality of demultiplexers, each of which includes first to third demultiplexing switch elements respectively controlled by first to third demultiplex control signals, one end of each of the demultiplexing switch elements being connected to one of the data lines, and the other end of each of the demultiplexing switch elements being connected to a pixels for the j-th color component ($1 \leqq j \leqq 3$, j is an integer) among the pixels, the method comprising:

setting an output from the driver circuit to the data lines to a high-impedance state, setting the first to third demultiplexing switch elements to an ON state by using the first to third demultiplex control signals, and accumulating a charge corresponding to a charge discharged from the data lines in a capacitor, one end of which is connected directly or through a specific component to the low-potential power line connected to a regulator which outputs the negative voltage, within a given period; and outputting the negative voltage generated by the regulator based on a voltage generated by the charge accumulated in the capacitor, as the low-potential drive power voltage, after the period.

According to a ninth aspect of the present invention, there is provided a power supply circuit which supplies a high-potential drive power voltage to a driver circuit which receives a low-potential drive power voltage in addition to the high-potential drive power voltage and drives a plurality of data lines in a display panel which has a plurality of pixels and a plurality of scanning lines in addition to the data lines, the power supply circuit comprising:

a regulator which operates using a first voltage supplied to a power line of the regulator as a power voltage, and outputs a voltage obtained by regulating an input voltage which is the first voltage or a voltage obtained by dividing the first voltage;

a first switching circuit, one end of the first switching circuit being connected with an output node to which the high-potential drive power voltage of the driver circuit is output and the other end of the first switching circuit being connected with output of the regulator; and a second switching circuit, one end of the second switching circuit being connected with the output node and the other end of the second switching circuit being connected with the power line, wherein:

the first switching circuit is turned off, the second switching circuit is turned on, and a charge corresponding to a charge discharged from the data lines is accumulated in a parasitic capacitor of the power line of the regulator during a given period in which an output from the driver circuit to the data lines is set to a high impedance state, and polarity of a voltage between a pixel electrode of each of the pixels connected to one of the data lines and a common electrode facing the pixel electrode through an electro-optical material is reversed; and the first switching circuit is turned on, the second switching circuit is turned off, and the regulated voltage is output to the output node by the regulator to which a voltage generated by the charge accumulated in the parasitic capacitor is supplied as a power voltage of the regulator.

According to a tenth aspect of the present invention, there is provided a power supply circuit which supplies a high-potential drive power voltage to a driver circuit which receives a low-potential drive power voltage in addition to the high-potential drive power voltage and drives a plurality of data lines in a display panel which has a plurality of pixels and a plurality of scanning lines in addition to the data lines, the power supply circuit comprising:

a regulator outputs a voltage obtained by regulating an input voltage which is a first voltage or a voltage obtained by dividing the first voltage;

a first switching circuit, one end of the first switching circuit being connected with an output node to which the high-potential drive power voltage of the driver circuit is output and the other end of the first switching circuit being connected with output of the regulator; and a second switching circuit, one end of which is connected to the output node;

a capacitor, one end of the capacitor being connected to the other end of the second switching circuit, and the other end of the capacitor being connected to a system power line; and a diode connected between the other end of the second switching circuit and a power line of the regulator to which is supplied a power voltage so that a direction from the system power line to the power line of the regulator is a forward direction, wherein:

the first switching circuit is turned off, the second switching circuit is turned on, and a charge corresponding to a charge discharged from the data lines is accumulated in the capacitor during a given period in which an output from the driver circuit to the data lines is set to a high impedance state, and polarity of a voltage between a pixel electrode of each of the pixels connected to one of the data lines and a common electrode facing the pixel electrode through an electro-optical material is reversed; and the first switching circuit is turned on, the second switching circuit is turned off, and the regulated voltage is output by the regulator to which a voltage generated by the charge accumulated in the parasitic capacitor is supplied as a power voltage of the regulator.

According to an eleventh aspect of the present invention, there is provided a power supply circuit which outputs a negative voltage to a driver circuit which receives high-potential and low-potential drive power voltages and drives a plurality of data lines in a display panel which has a plurality of pixels and a plurality of scanning lines in addition to the data lines, by utilizing a charge from a low-potential power line through which the low-potential drive power voltage is supplied, the power supply circuit comprising:

a regulator which outputs a voltage obtained by regulating a negative voltage input to the regulator;

a fourth switching circuit, one end of the fourth switching circuit being connected to an output node which outputs the low-potential drive power voltage for the driver circuit, and the other end of the fourth switching circuit being connected to a system ground power line to which a ground power voltage of the power supply circuit is supplied; and a fifth switching circuit, one end of the fifth switching circuit being connected to the output node, and the other end of the fifth switching circuit being connected to a low-potential power line of the regulator directly or through a specific device, wherein:

the fourth switching circuit is turned off, the fifth switching circuit is turned on, and a charge corresponding to a charge discharged from the data lines is accumulated in a parasitic capacitor of the low-potential power line of the regulator during a given period in which an output from the driver circuit to the data lines is set to a high impedance state, and polarity of a voltage between a pixel electrode of each of the pixels connected to one of the data lines and a common electrode facing the pixel electrode through an electro-optical material is reversed; and the fourth switching circuit is turned on, the fifth switching circuit is turned off, and a voltage generated by the charge accumulated in the parasitic capacitor is output to the low-potential power line of the regulator.

According to a twelfth aspect of the present invention, there is provided a power supply circuit which outputs a negative voltage to a driver circuit which receives high-potential and low-potential drive power voltages and drives a plurality of data lines in a display panel which has a plurality of pixels and a plurality of scanning lines in addition to the data lines, by utilizing a charge from a low-potential power line through which the low-potential drive power voltage is supplied, the power supply circuit comprising:

a regulator which outputs a voltage obtained by regulating a negative voltage input to the regulator;

a fourth switching circuit, one end of the fourth switching circuit being connected to an output node which outputs the low-potential drive power voltage for the driver circuit, and the other end of the fourth switching circuit being connected to a system ground power line to which aground power voltage of the power supply circuit is supplied;

a fifth switching circuit, one end of which is connected to the output node;

a capacitor, one end of the capacitor being connected to the other end of the fifth switching circuit, and the other end of the capacitor being grounded; and a diode connected between a low-potential power line of the regulator and the other end of the fifth switching circuit so that a direction from the low-potential power line of the regulator to the fifth switching circuit is a forward direction, wherein:

the fourth switching circuit is turned off, the fifth switching circuit is turned on, and a charge corresponding to a charge discharged from the data lines is accumulated in the capacitor during a given period in which an output from the driver circuit to the data lines is set to a high impedance state, and polarity of a voltage between a pixel electrode of each of the pixels connected to one of the data lines and a common electrode facing the pixel electrode through an electro-optical material is reversed; and the fourth switching circuit is turned on, the fifth switching circuit is turned off, and a voltage generated by the charge accumulated in the capacitor is output to the low-potential power line of the regulator.

DETAILED DESCRIPTION OF THE EMBODIMENTS

Embodiments of the present invention are described below. Note that the embodiments described hereunder do not in any way limit the scope of the invention laid out in the claims herein. Note also that all of the elements described below should not be taken as essential requirements for the present invention.

In a simple matrix type liquid crystal panel or an active matrix type liquid crystal panel, a liquid crystal is driven so that the voltage applied to the liquid crystal which makes up a pixel alternates. As such an alternating drive method, a line reverse drive method and a frame reverse drive method have been known. In the line reverse drive method, the liquid crystal is driven so that the polarity of the voltage applied to the liquid crystal is reversed in units of one or more lines. In the frame reverse drive method, the liquid crystal is driven so that the polarity of the voltage applied to the liquid crystal is reversed in each frame.

In the polarity reverse drive method in which the polarity of the voltage applied to the liquid crystal is reversed, charging of the data line of the liquid crystal panel and discharging from the data line are alternately repeated. As a result, a charge discharged from the data line is returned to a driver circuit which drives the data line.

The driver circuit drives the data line by using a voltage-follower-connected operational amplifier, for example. The charge returned to the driver circuit is then returned to a ground power line of the driver circuit by the operational amplifier. This makes it necessary to recharge the data line by using the operational amplifier, whereby power consumption is increased.

According to the following embodiments, a power supply method and a power supply circuit which reduce power consumption by utilizing a charge discharged from the data line by the polarity reverse drive can be provided.

Embodiments of the present invention are described below in detail with reference to the drawings. Although the embodiments applied to a TFT panel which is an active matrix type liquid crystal panel are described below by way of example, the present invention is not limited thereto.

1. Liquid Crystal Device (Electro-Optical Device)

Figure 1:
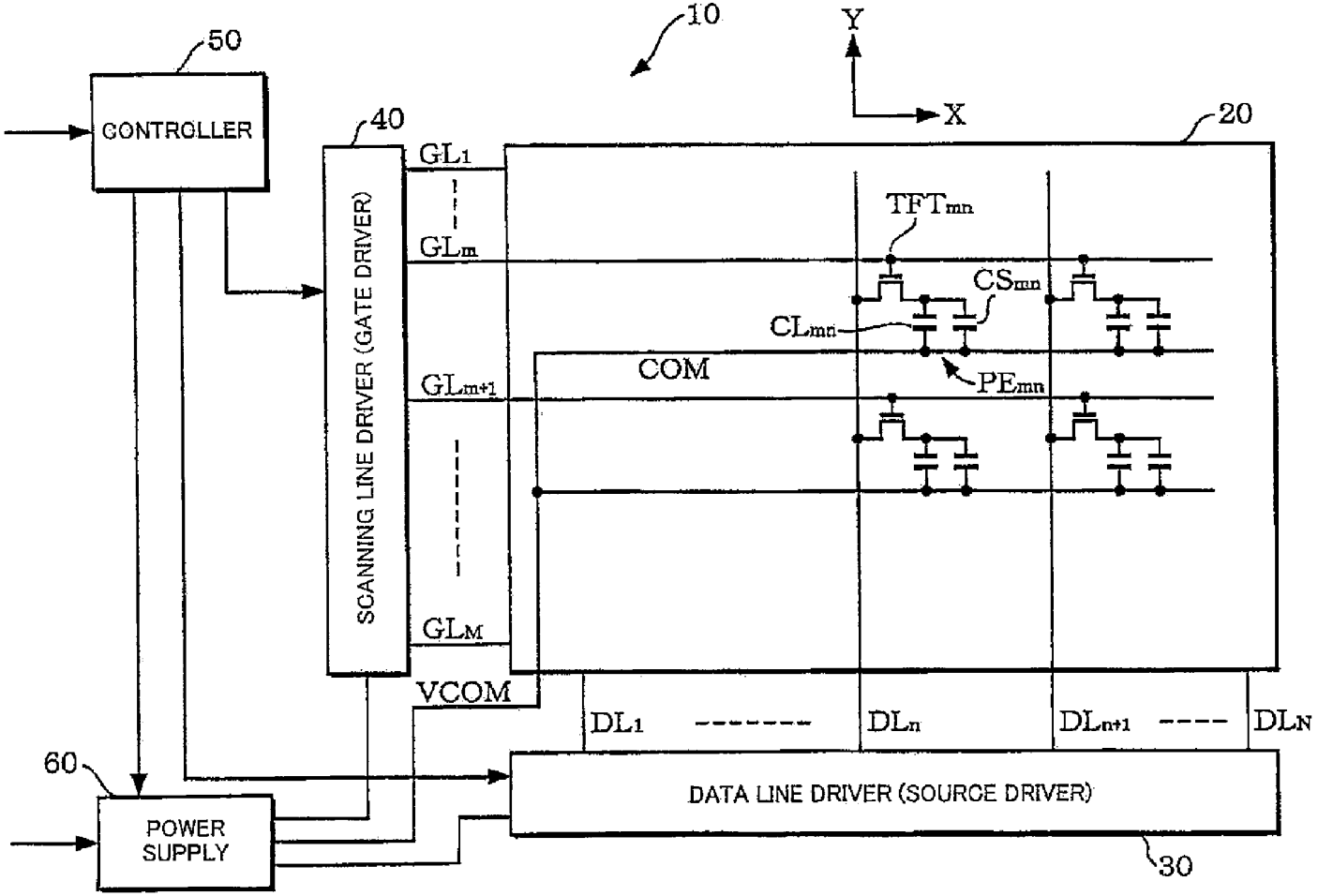
FIG. 1 is a diagram schematically showing the configuration of a liquid crystal device.

FIG. 1 schematically shows the configuration of a liquid crystal device. The liquid crystal device may be incorporated into various electronic instruments such as a portable telephone, portable information instrument (PDA, etc.), digital camera, projector, portable audio player, mass storage device, video camera, electronic notebook, or global positioning system (GPS).

In FIG. 1, a liquid crystal device 10 includes a liquid crystal panel 20, a data line driver circuit (source driver in a narrow sense) 30, a scanning line driver circuit (gate driver in a narrow sense) 40, a controller 50, and a power supply circuit 60. The liquid crystal device 10 does not necessarily include all of these circuit blocks. The liquid crystal device 10 may have a configuration in which some of these circuit blocks are omitted.

The liquid crystal panel 20 includes a plurality of scanning lines (gate lines), a plurality of data lines (source lines), and a plurality of pixels. Each of the pixels is specified by one of the scanning lines and one of the data lines. Each of the pixels includes a TFT and a pixel electrode. The TFT is connected with the data line, and a pixel electrode is connected with the TFT.

In more detail, the liquid crystal panel 20 is formed on a panel substrate formed of a glass substrate, for example. A plurality of scanning lines $GL_1$ to $GL_M$ (M is an integer more than one) which are arranged in the Y direction shown in FIG. 1 and extend in the X direction, and a plurality of data lines $DL_1$ to $DL_N$ (N is an integer more than one) which are arranged in the X direction and extend in the Y direction are disposed on the panel substrate. A pixel $PE_{mn}$ is disposed at a location corresponding to the intersecting point of the scanning line $GL_m$ ($1 \leqq m \leqq M$, m is an integer) and the data line $DL_n$ ($1 \leqq n \leqq N$, n is an integer). The pixel $PE_{mn}$ includes the $TFT_{mn}$ and the pixel electrode.

A gate electrode of the $TFT_{mn}$ is connected with the scanning line $GL_m$. A source electrode of the $TFT_{mn}$ is connected with the data line $DL_n$. A drain electrode of the TFT, is connected with the pixel electrode. A liquid crystal capacitor $CL_{mn}$ and a storage capacitor $CS_{mn}$ are formed between the pixel electrode and a common electrode COM which faces the pixel electrode through a liquid crystal element (electro-optical substance in a broad sense). The transmissivity of the liquid crystal element is changed corresponding to the voltage applied between the pixel electrode and the common electrode COM. A voltage VCOM supplied to the common electrode COM is generated by the power supply circuit 60.

The data line driver circuit 30 drives the data lines $DL_1$ to $DL_N$ of the liquid crystal panel 20 based on display data. The scanning line driver circuit 40 scans the scanning lines $GL_1$ to $GL_M$ of the liquid crystal panel 20.

The controller 50 outputs control signals to the data line driver circuit 30, the scanning line driver circuit 40, and the power supply circuit 60 according to the contents set by a host such as a central processing unit (hereinafter abbreviated as "CPU") (not shown). In more detail, the controller 50 supplies the operation mode setting and a horizontal synchronization signal or a vertical synchronization signal generated therein to the data line driver circuit 30 and the scanning line driver circuit 40, for example. The controller 50 controls polarity reversal timing of the voltage VCOM of the common electrode COM generated by the power supply circuit 60.

The power supply circuit 60 generates various voltages of the liquid crystal panel 20 and the voltage VCOM of the common electrode COM based on a reference voltage supplied from the outside. In more detail, the power supply circuit 60 includes a charge pump circuit, and generates a plurality of power voltages in the positive direction and the negative direction with respect to the ground power voltage, and the voltage VCOM of the common electrode COM. The power voltage in the negative direction with respect to the ground power voltage is output to the scanning line driver circuit 40, for example.

In the power supply circuit 60, the power voltages and the voltage VCOM generated therein are regulated by using a regulator (voltage regulator circuit). The regulated voltages are then output. The regulator is formed by using a voltage-follower-connected operational amplifier, for example.

In FIG. 1, the liquid crystal device 10 includes the controller 50. However, the controller 50 may be provided outside the liquid crystal device 10. The host (not shown) may be included in the liquid crystal device 10 together with the controller 50.

At least one of the scanning line driver circuit 40, the controller 50, and the power supply circuit 60 may be included in the data line driver circuit 30. Some or all of the data line driver circuit 30, the scanning line driver circuit 40, the controller 50, and the power supply circuit 60 may be formed on the liquid crystal panel 20.

The liquid crystal element deteriorates if a direct-current voltage is applied to the liquid crystal element for a long period of time. Therefore, a drive method in which the polarity of the voltage applied to the liquid crystal element is alternately reversed is necessary. As such a drive method, a frame reverse drive method, scanning (gate) line reverse drive method, data (source) line reverse drive method, dot reverse drive method, and the like can be given.

Figure 2:
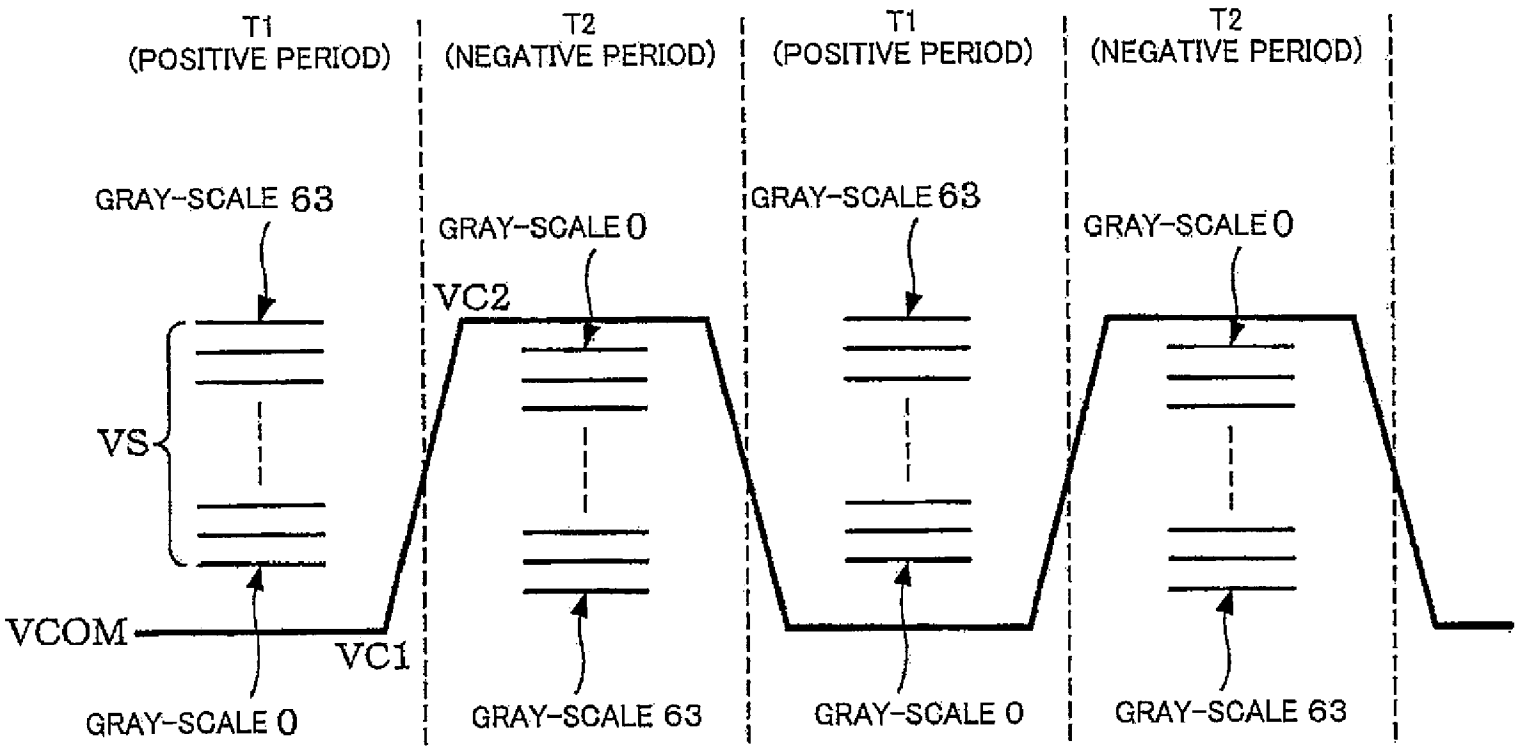
FIG. 2 is a diagram for illustrating a scanning line reverse drive method.

FIG. 2 is a diagram for illustrating the scanning line reverse drive method. In the scanning line reverse drive method, the polarity of the voltage applied to the liquid crystal element is reversed every scanning period (in units of one or more scanning lines), for example.

For example, a positive voltage is applied to the liquid crystal element in the k-th scanning period (select period of the scanning line $GL_k$) ($1 \leqq k \leqq M$, k is an integer), a negative voltage is applied to the liquid crystal element in the (k+1)-th scanning period, and a positive voltage is applied to the liquid crystal element in the (k+2)-th scanning period. In the next frame, a negative voltage is applied to the liquid crystal element in the k-th scanning period, a positive voltage is applied to the liquid crystal element in the (k+1)-th scanning period, and a negative voltage is applied to the liquid crystal element in the (k+2)-th scanning period.

In the scanning line reverse drive method, the polarity of the voltage (common voltage) VCOM of the common electrode COM is reversed every scanning period.

In more detail, the common voltage VCOM becomes a voltage VC1 (first common voltage) in a positive period T1 (first period) and becomes a voltage VC2 (second common voltage) in a negative period T2 (second period).

The positive period T1 is a period in which a voltage VS of the data line (pixel electrode) is higher than the common voltage VCOM. In the period T1, a positive voltage is applied to the liquid crystal element. The negative period T2 is a period in which the voltage VS of the data line is lower than the common voltage VCOM. In the period T2, a negative voltage is applied to the liquid crystal element. The voltage VC2 is a voltage which is the reverse of the voltage VC1 with respect to a given voltage.

The voltage necessary for driving the liquid crystal panel can be reduced by reversing the polarity of the common voltage VCOM in this manner. This enables the withstand voltage of the driver circuit to be reduced, whereby the manufacturing process of the driver circuit can be simplified and the manufacturing cost can be reduced.

1.1 First Embodiment

In the above-described polarity reverse drive method, charging of and discharging from the data line are alternately repeated. As a result, a charge discharged from the data line is returned to the power line of the data line driver circuit 30. This makes it necessary to supply a charge to the data line again, whereby power consumption is increased.

This point is described below.

The configuration of the data line driver circuit 30 is described at first.

Figure 3:
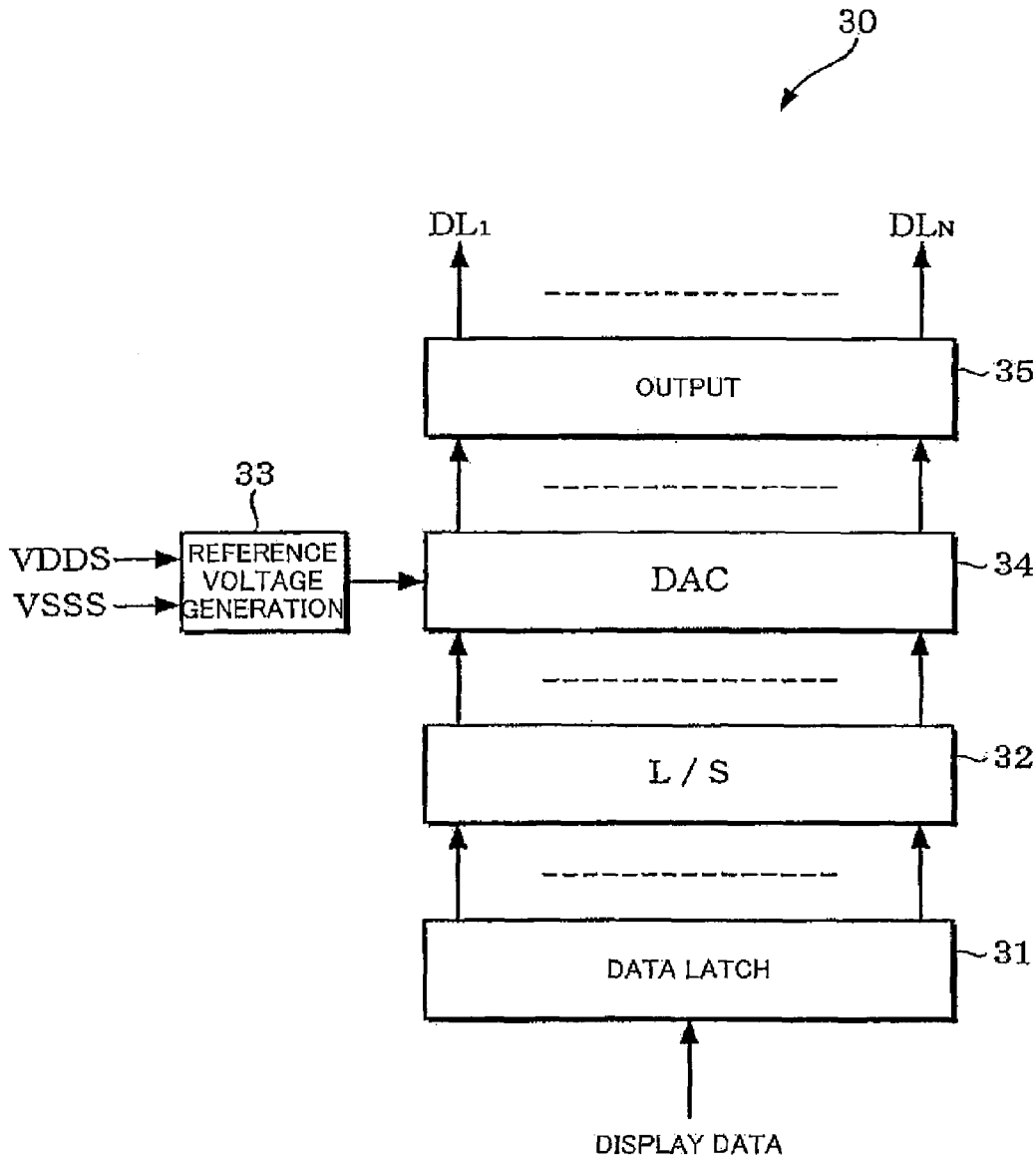
FIG. 3 is a block diagram of a data line driver circuit.

FIG. 3 shows an example of the data line driver circuit 30. A high-potential power line to which a high-potential drive power voltage VDDS is supplied, and a low-potential-side (ground) power line to which a low-potential drive power voltage VSSS is supplied, are connected with the data line driver circuit 30. The high-potential drive power voltage VDDS and the low-potential drive power voltage VSSS are generated by the power supply circuit 60.

The data line driver circuit 30 includes a data latch 31, a level shifter (L/S) 32, a reference voltage generation circuit 33, a voltage select circuit (digital-to-analog converter: DAC) 34, and an output circuit 35.

The data latch 31 latches the display data. The display data includes a plurality of pieces of gray-scale data divided in units of data lines. The LJS 32 shifts the voltage level of the output of the data latch 31.

The reference voltage generation circuit 33 generates a plurality of reference voltages obtained by dividing the voltage between the high-potential drive power voltage VDDS and the low-potential drive power voltage VSSS. The reference voltage generation circuit 33 includes a resistance ladder to which the high-potential drive power voltage. VDDS and the low-potential drive power voltage VSSS are connected on each end, for example. In this case, the reference voltages are generated from a plurality of voltage division terminals of the resistance ladder. Each of the reference voltages becomes a gray-scale voltage corresponding to the gray-scale data.

The DAC 34 converts the output of the L/S 32 into an analog gray-scale voltage by using the reference voltages generated by the reference voltage generation circuit 33. In more detail, the DAC 34 decodes the gray-scale data and selects one of the reference voltages based on the decoding result. The reference voltage selected by the DAC 34 is output to the output circuit 35 as an analog gray-scale voltage.

The output circuit 35 drives the data lines $DL_1$ to $DL_N$ based on the analog gray-scale voltage output from the DAC 34. In the output circuit 35, voltage-follower-connected operational amplifiers as impedance conversion circuits are provided in units of the data lines.

Figure 4:
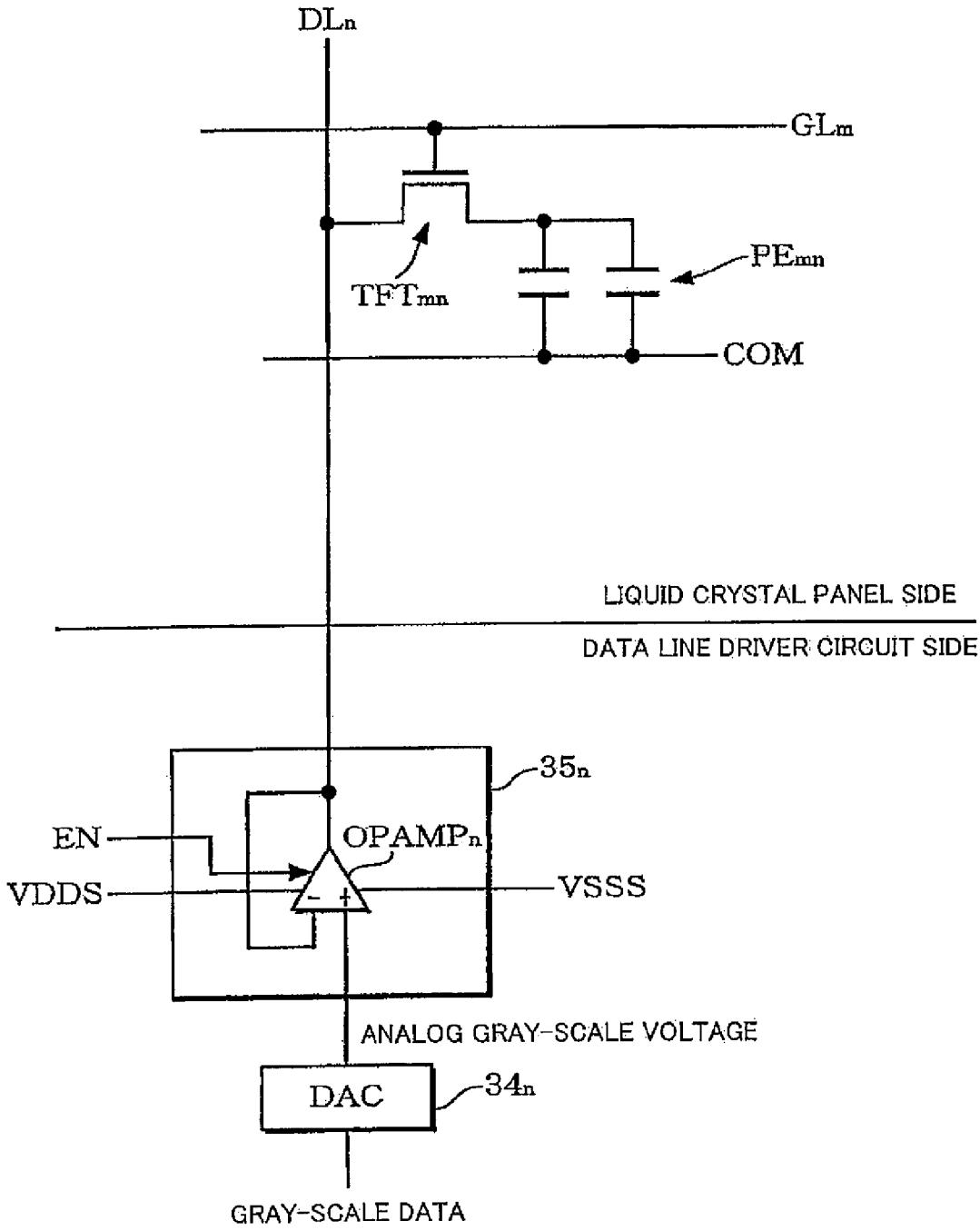
FIG. 4 is a diagram showing a major portion of a data line driver circuit.

FIG. 4 shows a major portion of the data line driver circuit 30. In more detail, FIG. 4 shows a major portion of the data line driver circuit 30 for driving the data line $DL_n$.

The gray-scale data corresponding to the data line $DL_n$ is converted into an analog gray-scale voltage by the DAC $\mathbf{34}_n$. The analog gray-scale voltage is input to the output circuit $\mathbf{35}_n$. The output circuit $\mathbf{35}_n$ includes a voltage-follower-connected operational amplifier $OPAMP_n$. The output circuit $\mathbf{35}_n$ drives the data line $DL_n$ by using the voltage-follower-connected operational amplifier $OPAMP_n$.

The output circuit $\mathbf{35}_n$ is set to either an enabled state or a disabled state by an enable signal EN. In the case where the output circuit $\mathbf{35}_n$ is set to a disabled state by the enable signal EN, the output circuit $\mathbf{35}_n$ sets its output at a high impedance state. A voltage corresponding to the gray-scale data is applied to the data line $DL_n$ driven by the output circuit $\mathbf{35}_n$ which is set to an enabled state.

The voltage VCOM of the common electrode COM is alternately set to the voltage VC1 and the voltage VC2 by the above-described polarity reverse drive method, whereby the polarity of the voltage applied to the liquid crystal element is reversed. As a result, a charge accumulated in the data line $DL_n$ is discharged in synchronization with the polarity reversal timing.

In more detail, in the case where the voltage-follower-connected operational amplifier $OPAMP_N$ is operated at an operating voltage between the high-potential drive power voltage VDDS and the low-potential drive power voltage VSSS, a charge accumulated in the data line $DL_n$ is returned to either the high-potential power line to which the high-potential drive power voltage VDDS is supplied or the low-potential power line to which the low-potential drive power voltage VSSS is supplied in synchronization with the polarity reversal timing.

Figure 5:
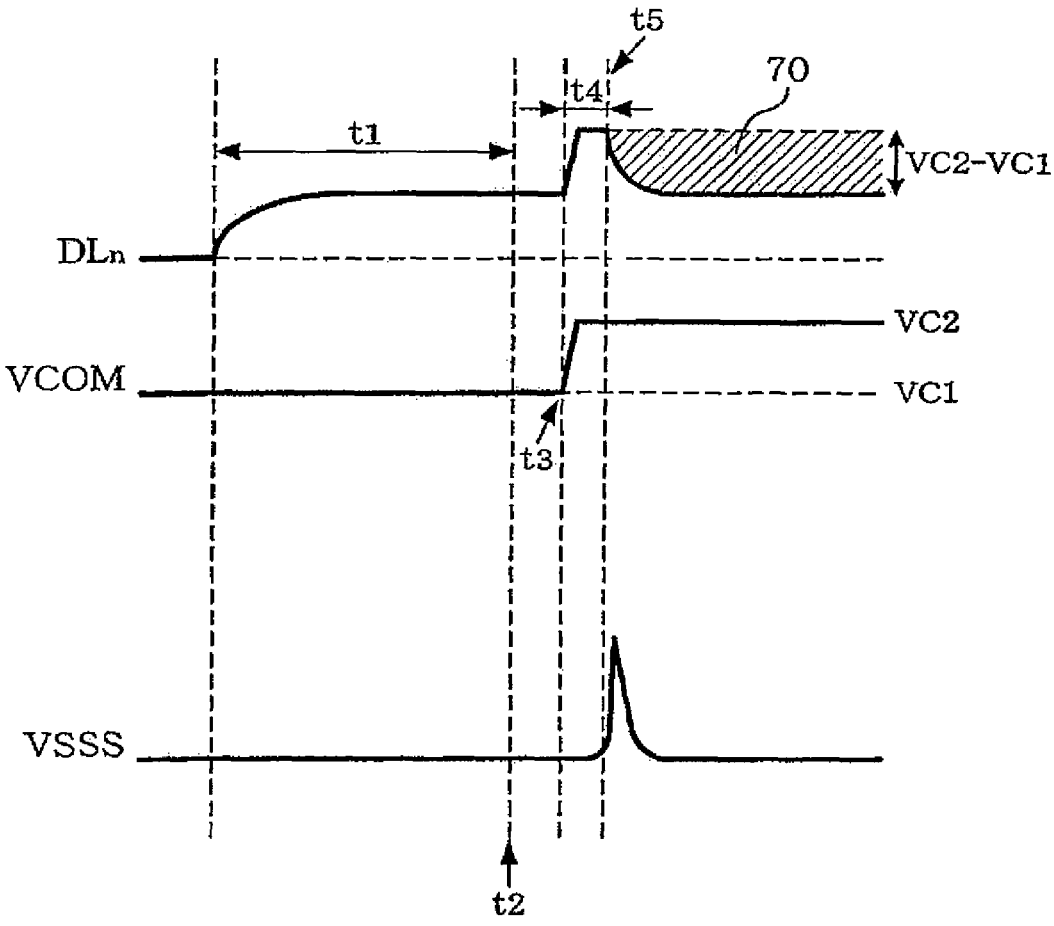
FIG. 5 is a diagram for illustrating a discharge from a data line.

FIG. 5 is a diagram for illustrating a discharge from the data line. The voltage VCOM of the common electrode is the voltage VC1. As shown in FIG. 4, the data line $DL_n$ is driven by the output circuit $\mathbf{35}_n$ of the data line driver circuit 30.

The data line $DL_n$ is charged (t1), and the voltage of the data line $DL_n$ is increased to 5 V, for example. The scanning line $GL_m$ is selected, whereby the $TFT_{mn}$ is turned ON. The voltage of the data line $DL_n$ is written in the pixel electrode connected with the $TFT_{mn}$, and the $TFT_{mn}$ is turned OFF (t2).

When the voltage VCOM of the common electrode is changed from the voltage VC1 ("L" level) to the voltage VC2 ("H" level) at a polarity reversal timing t3, the voltage of the data line $DL_n$ is relatively increased in the amount of a voltage (VC2−VC1) (t4). In the case where the voltage of the data line $DL_n$ becomes 5 V in the period t1 and the voltage VC1 and the voltage VC2 are respectively 0 V and 5 V, the voltage of the data line $DL_n$ becomes 10 V in the period t4 after the polarity reversal timing t3.

However, the output circuit $\mathbf{35}_n$ of the data line driver circuit 30 which drives the data line $DL_n$ is formed so that the charge on the signal line to which a voltage higher than the reference voltage is applied is discarded to the low-potential power line. In the case where the data line $DL_n$ is driven by the voltage-follower-connected operational amplifier $OPAMP_n$ as shown in FIG. 4, if the voltage of the data line $DL_n$ becomes higher than the voltage of the input signal, the data line $DL_n$ is electrically connected with the low-potential power line to which the low-potential drive power voltage VSSS is supplied. Therefore, the charge discharged through the data line, $DL_n$ flows toward the low-potential power line.

Figure 6:
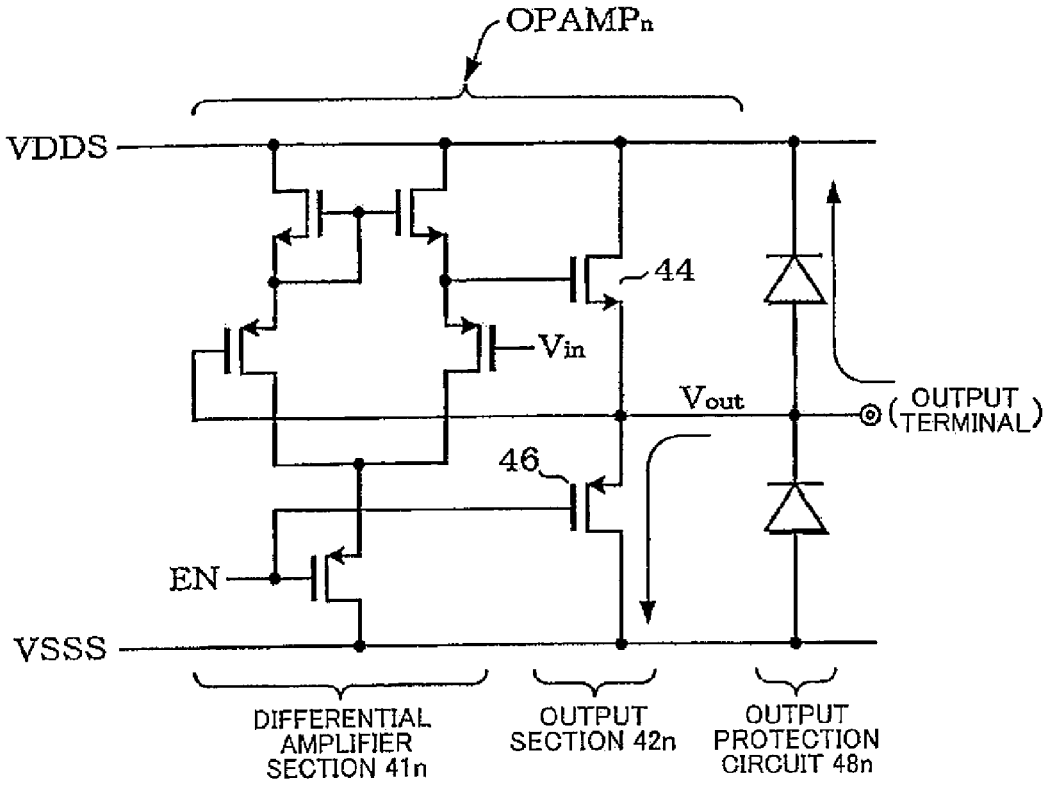
FIG. 6 is a circuit diagram showing a voltage-follower-connected operational amplifier.

FIG. 6 is a circuit diagram showing the configuration of the voltage-follower-connected operational amplifier $OPAMP_n$. An analog gray-scale voltage is input as an input voltage Vin of the voltage-follower-connected operational amplifier $OPAMP_n$. An output voltage Vout of the voltage-follower-connected operational amplifier $OPAMP_n$ is output to the data line $DL_n$. The voltage-follower-connected operational amplifier $OPAMP_n$ includes a differential amplifier section $\mathbf{41}_n$ and an output section $\mathbf{42}_n$.

In the case where the output voltage Vout is higher than the input voltage Vin, a p-type transistor 44 in the output section $\mathbf{42}_n$ is turned OFF. Therefore, the output signal line to which the output voltage Vout is applied is electrically connected with the low-potential power line through a constant current source made up of an n-type transistor 46 which is turned ON by the enable signal EN.

In the case where the data line $DL_n$ is driven by the voltage-forlower-connected operational amplifier $OPAMP_n$, if the voltage of the data line $DL_n$ which is the output voltage becomes higher than the voltage of the input signal as shown in FIG. 5, the charge flows toward the low-potential power line to which the low-potential drive power voltage VSSS is supplied, whereby the voltage of the data line $DL_n$ is returned to the high-potential drive power voltage VDDS supplied to the high-potential power line (t5). Therefore, electric power corresponding to the charge discharged from the data line $DL_n$ indicated by a slanted line portion 70 shown in FIG. 5 is consumed uselessly, whereby power consumption is increased.

In the first embodiment, a charge discharged from the data line $DL_n$ is reutilized by forming the power supply circuit 60 as described below, thereby realizing a reduction of power consumption.

In the first embodiment, the output of the output circuit $\mathbf{35}_n$ is set at a high impedance state in a given period including the polarity reversal timing. This allows a charge discharged from the data line $DL_n$ to be accumulated in the output signal line. Therefore, the voltage of the output signal line is increased.

However, an output protection circuit $\mathbf{48}_n$, is connected with the output terminal of the data line driver circuit 30. The output protection circuit $\mathbf{48}_n$ is made up of a diode device or a transistor. Therefore, the charge accumulated in the output signal line flows toward the high-potential power line. As a result, the high-potential drive power voltage of the data line driver circuit 30 is increased.

The high-potential drive power voltage of the data line driver circuit 30 is supplied through the high-potential power line connected to the power supply circuit 60. The power supply circuit 60 supplies the high-potential drive power voltage to the high-potential power line by using a regulator. In the case where the regulator is formed by using the above-described voltage-follower-connected operational amplifier, if the high-potential drive power voltage which has been increased as described above is directly returned to the output of the operational amplifier, the charge is returned to the ground power line of the power supply circuit 60, whereby power consumption is increased.

In the power supply circuit 60 in the first embodiment, the charge on the high-potential power line is accumulated by providing a switching circuit, and the power voltage is supplied to the regulator which drives the high-potential power line by utilizing the accumulated charge. This enables consumption of electric power corresponding to the slanted line portion 70 shown in FIG. 5 to be prevented.

Figure 7:
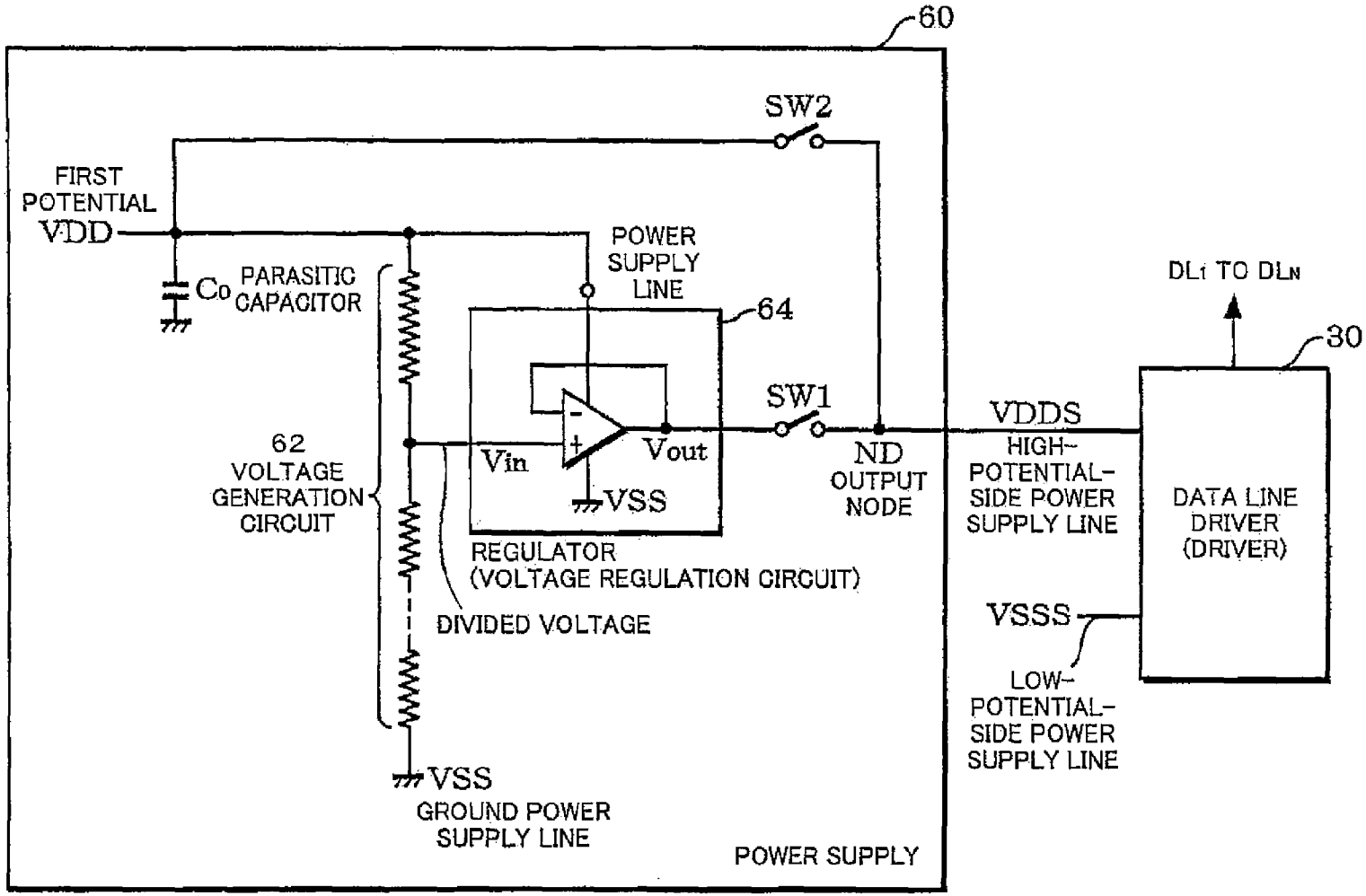
FIG. 7 is a diagram schematically showing the configuration of a power supply circuit according to a first embodiment of the present invention.

FIG. 7 schematically shows the configuration of the power supply circuit 60 in the first embodiment. The power supply circuit 60 includes a voltage generation circuit 62, a regulator 64 as the voltage regulator circuit, and first and second switching circuits SW1 and SW2.

The voltage generation circuit 62 includes a power line to which a first voltage as a system power voltage VDD is supplied, and a resistance ladder connected between the power line and a ground power line to which a system ground power voltage VSS is supplied, for example. Various power voltages are produced from a voltage division terminal of the resistance ladder. In FIG. 7, the resistance ladder is connected so that the power voltage produced from one voltage division terminal is input to the regulator 64. However, the first voltage may be input to the regulator 64.

The regulator 64 is formed by the voltage-follower-connected operational amplifier including the differential amplifier section and the output section shown in FIG. 6. The regulator 64 drives the high-potential power line of the data line driver circuit 30.

The first and second switching circuits SW1 and SW2 are connected with an output node ND of the power supply circuit 60 which is connected with the high-potential power line. The other end of the first switching circuit SW1 is connected with the output of the regulator 64. The other end of the second switching circuit SW2 is connected with the power line to which the first voltage is supplied. The first switching circuit SW1 is ON/OFF controlled by a SW1 control signal. The second switching circuit SW2 is ON/OFF controlled by a SW2 control signal.

In the power supply circuit 60 in the first embodiment, the output node ND is connected with the signal line (power line) of the regulator 64 to which the power voltage is supplied, and a charge accumulated in the high-potential power line is accumulated in a parasitic capacitor $C_0$ of the power line. The parasitic capacitor $C_0$ may be referred to as a capacitor formed between the power line and a specific signal line or the substrate.

Figure 8:
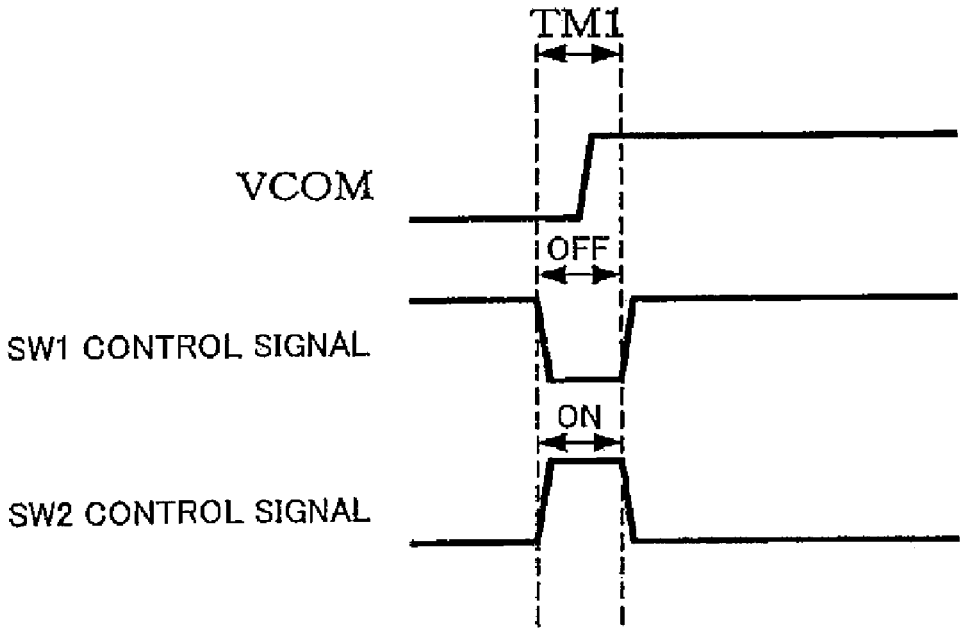
FIG. 8 is a timing chart showing a control timing of first and second switching circuits.

FIG. 8 shows an example of control timing of the first and second switching circuits SW1 and SW2. The output of the output circuit $35_n$ of the data line driver circuit 30 is set at a high impedance state in a period TM1 (given period) including the polarity reversal timing. In more detail, the output of the output circuit $35_n$ of the data line driver circuit 30 is set at a high impedance state in the period TM1 including the polarity reversal timing at which the voltage VCOM of the common electrode COM is changed from the "L" level to the "H" level. This allows the charge to be discharged from the data line, whereby the voltage of the high-potential power line of the data line driver circuit 30 is increased.

In the period TM1, the first switching circuit SW1 is turned OFF by the SW1 control signal, and the second switching circuit SW2 is turned ON by the SW2 control signal. This allows the output node ND to be electrically connected with the power line of the regulator 64. Therefore, the charge on the high-potential power line is accumulated in the parasitic capacitor $C_0$ of the power line.

After the period TM1 has elapsed, the first switching circuit SW1 is turned ON by the SW1 control signal, and the second switching circuit SW2 is turned OFF by the SW2 control signal. This allows the output node ND to be electrically isolated from the power line of the regulator 64 and electrically connected with the output of the regulator 64. The regulator 64 drives the high-potential power line based on the divided voltage of the voltage generation circuit 62 by using a voltage generated by the parasitic capacitor $C_0$ of the power line.

A given period may include at least one of a specific period before the polarity reversal timing and a specific period after the polarity reversal timing.

This enables power consumption to be reduced by reutilizing the charge which is originally discarded to the ground side by the polarity reverse drive.

1.2 Modification

In FIG. 7, the charge on the high potential power line is accumulated in the parasitic capacitor of the signal line (power line) of the regulator 64 to which the power voltage is supplied. However, the present invention is not limited thereto. In the power supply circuit in this modification example, a capacitor C is formed between the other end of the second switching circuit SW2 and the system power line to which the system power voltage VDD is supplied, and the charge on the high potential power line is accumulated in the capacitor C.

Figure 9:
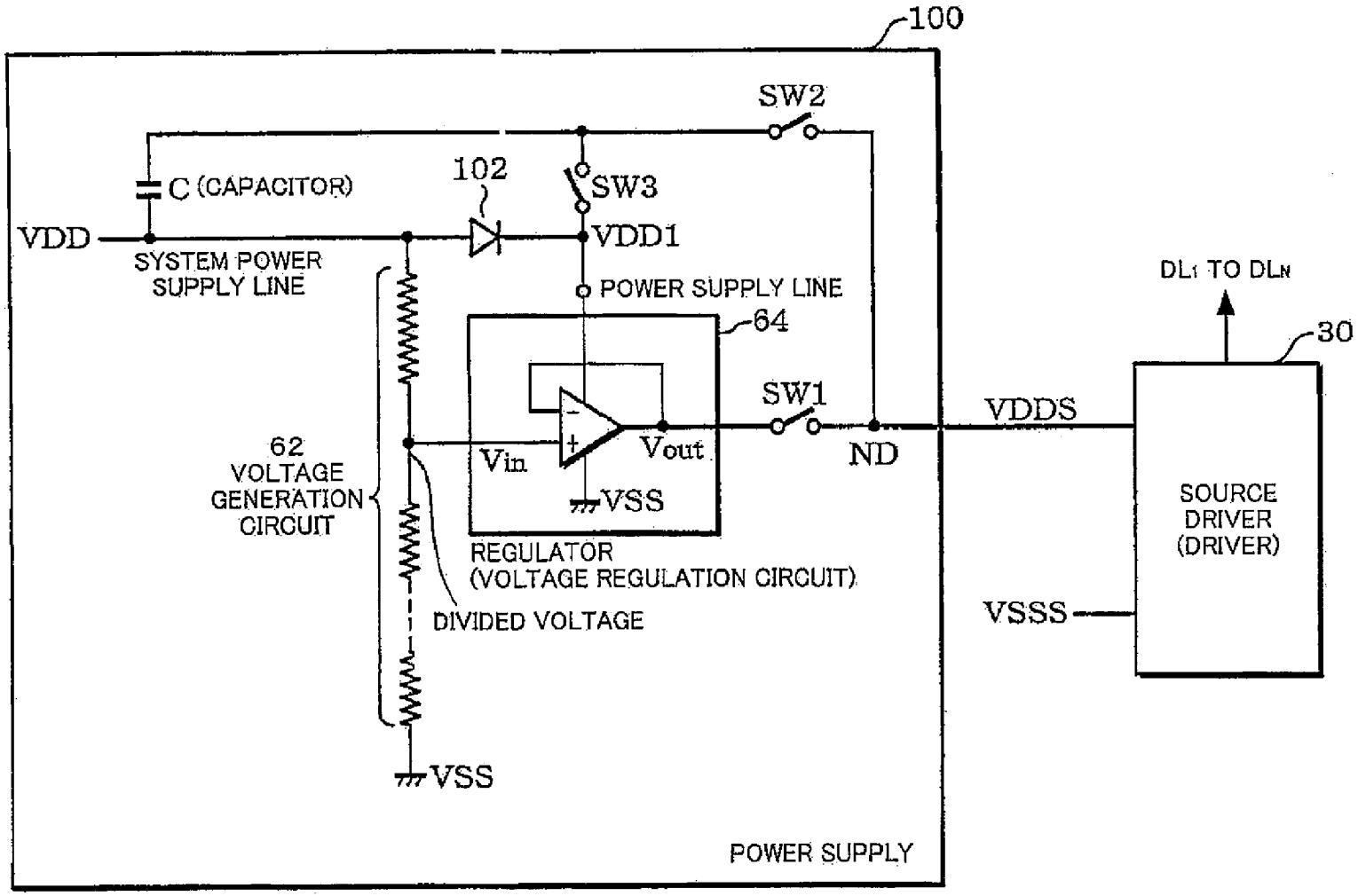
FIG. 9 is a diagram showing the power supply circuit according to a modification of the first embodiment.

FIG. 9 shows the power supply circuit according to a modification of the first embodiment. Note that components corresponding to those in the power supply circuit 60 of FIG. 7 are denoted by the same reference numbers and further description thereof is omitted. A power supply circuit 100 in this modification differs from the power supply circuit 60 of FIG. 7 in that the power supply circuit 100 includes a third switching circuit SW3; a capacitor C, and a diode device (specific device) 102.

The third switching circuit SW3 is connected between the other end of the second switching circuit SW2 and the power line of the regulator 64. The third switching circuit SW3 is ON/OFF controlled by a SW3 control signal.

The capacitor C is connected between the other end of the second switching circuit SW2 and the system power line. The system power line is a power line to which the system power supply VDD is supplied. The system power line may be referred to as a signal line for supplying the power voltage of the regulator.

The diode device 102 is connected between the system power line and the power line of the regulator 64. In more detail, the diode device 102 is connected so that the direction from the system power line to the power line of the regulator 64 is the forward direction.

Figure 10:
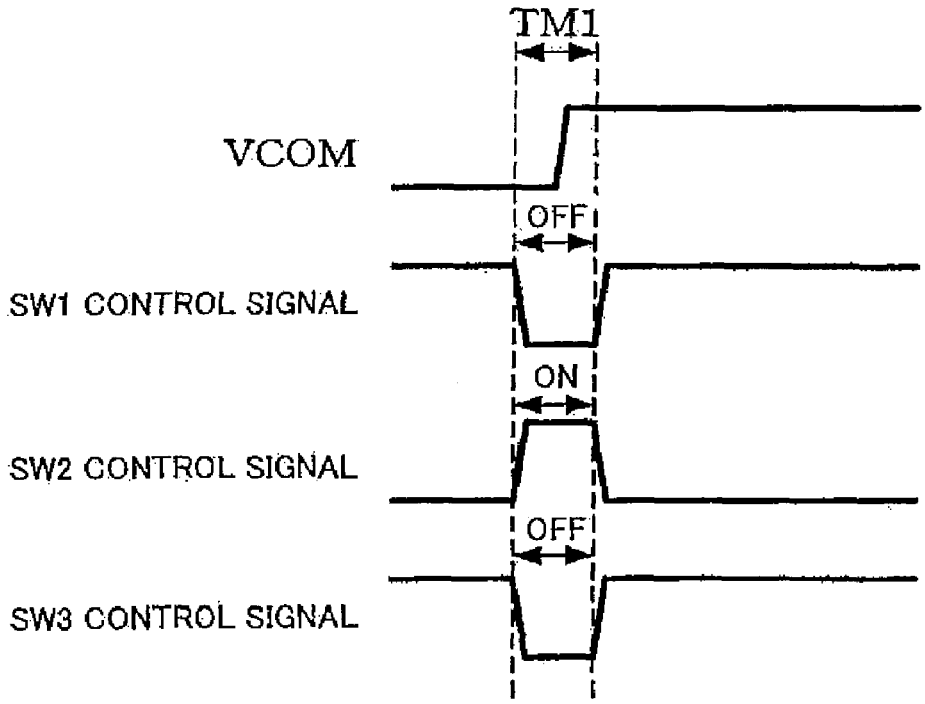
FIG. 10 is a timing chart showing a control timing of first to third switching circuits.

FIG. 10 shows an example of control timing of the first to third switching circuits SW1 to SW3. The control timing of the first and second switching circuits SW1 and SW2 is the same as the control timing shown in FIG. 8. The SW3 control signal is changed at the same timing as the SW1 control signal.

In the period TM1, the first and third switching circuits SW1 and SW3 are turned OFF by the SW1 control signal and the SW3 control signal, and the second switching circuit SW2 is turned ON by the SW2 control signal. This allows the charge of the output node ND of which the voltage is increased to be accumulated in the capacitor C.

After the period TM1 has elapsed, the first and third switching circuits SW1 and SW3 are turned ON by the SW1 control signal and the SW3 control signal, and the second switching circuit SW2 is turned OFF by the SW2 control signal. This allows a voltage generated by the capacitor C to be supplied to the power line of the regulator 64. The regulator 64 drives the high-potential power line based on the divided voltage of the voltage generation circuit 62 by using the voltage generated by the capacitor C. This enables power consumption to be reduced by reutilizing the charge which is originally discarded to the ground side by the polarity reverse drive.

Figure 11:
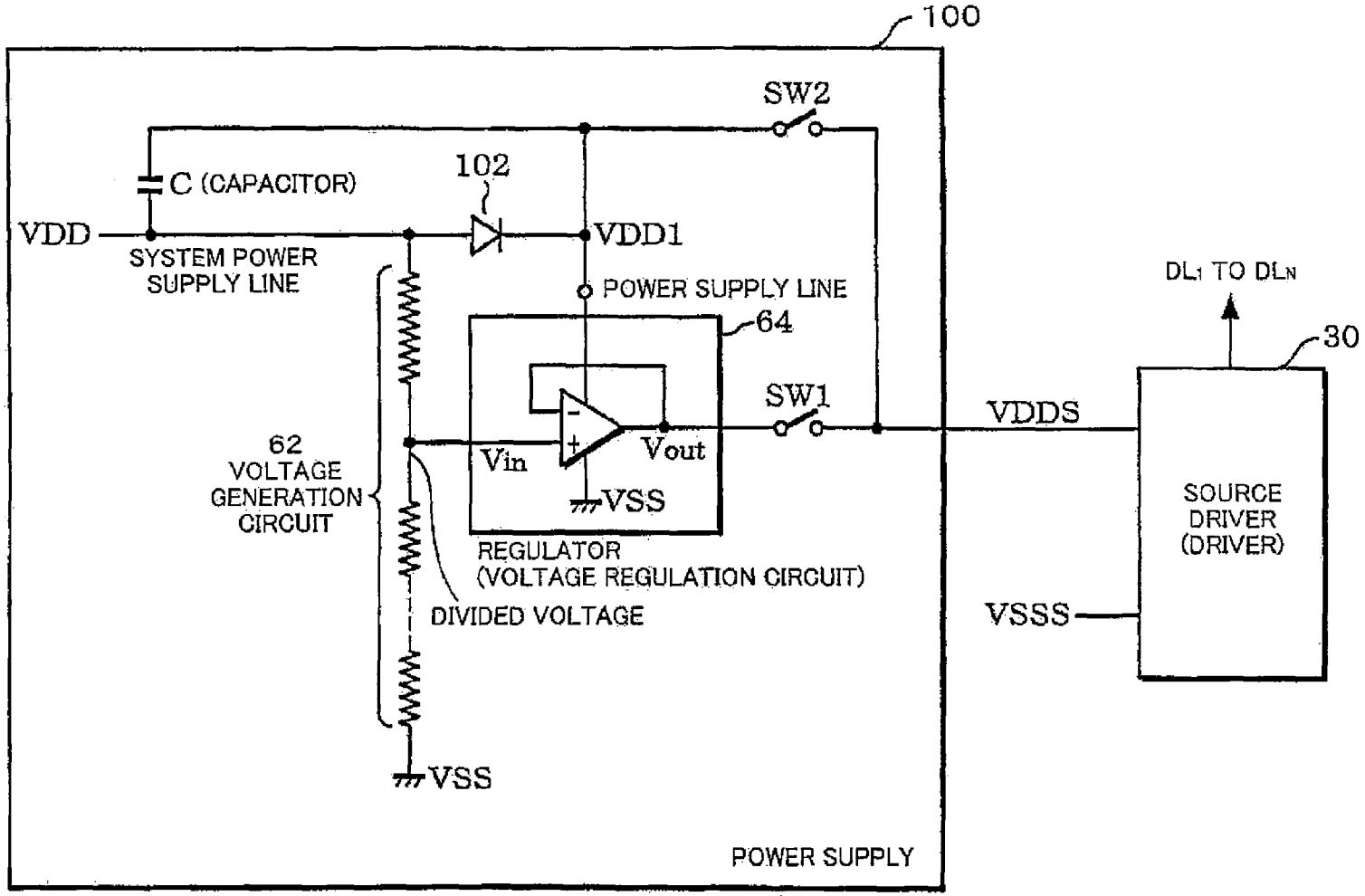
FIG. 11 is a diagram showing the power supply circuit of FIG. 9 from which the third switching circuit is omitted.

As shown in FIG. 11, the power supply circuit may have a configuration in which the third switching circuit SW3 is omitted. In this case, each end of the capacitor C is connected through the diode device 102. Therefore, the charge on the high-potential power line can be accumulated in the capacitor C.

1.3 Second Embodiment

In the second embodiment, a negative voltage supplied to the scanning line driver circuit 40 is generated by utilizing a charge which is originally discarded by replacing part of the components of the first embodiment with the following components or adding following components to the configuration of the first embodiment, for example.

In the first embodiment, the charge on the data line discharged to the high-potential power line of the data line driver circuit is accumulated when the voltage VCOM of the common electrode COM is changed from the "L" level to the "H" level. In the following configuration in the second embodiment, the charge on the data line discharged to the low-potential power line of the data line driver circuit is accumulated when the voltage VCOM of the common electrode COM is changed from the "H" level to the "L" level. A negative voltage is generated by reutilizing the charge on the data line discharged to the low-potential power line.

Figure 12:
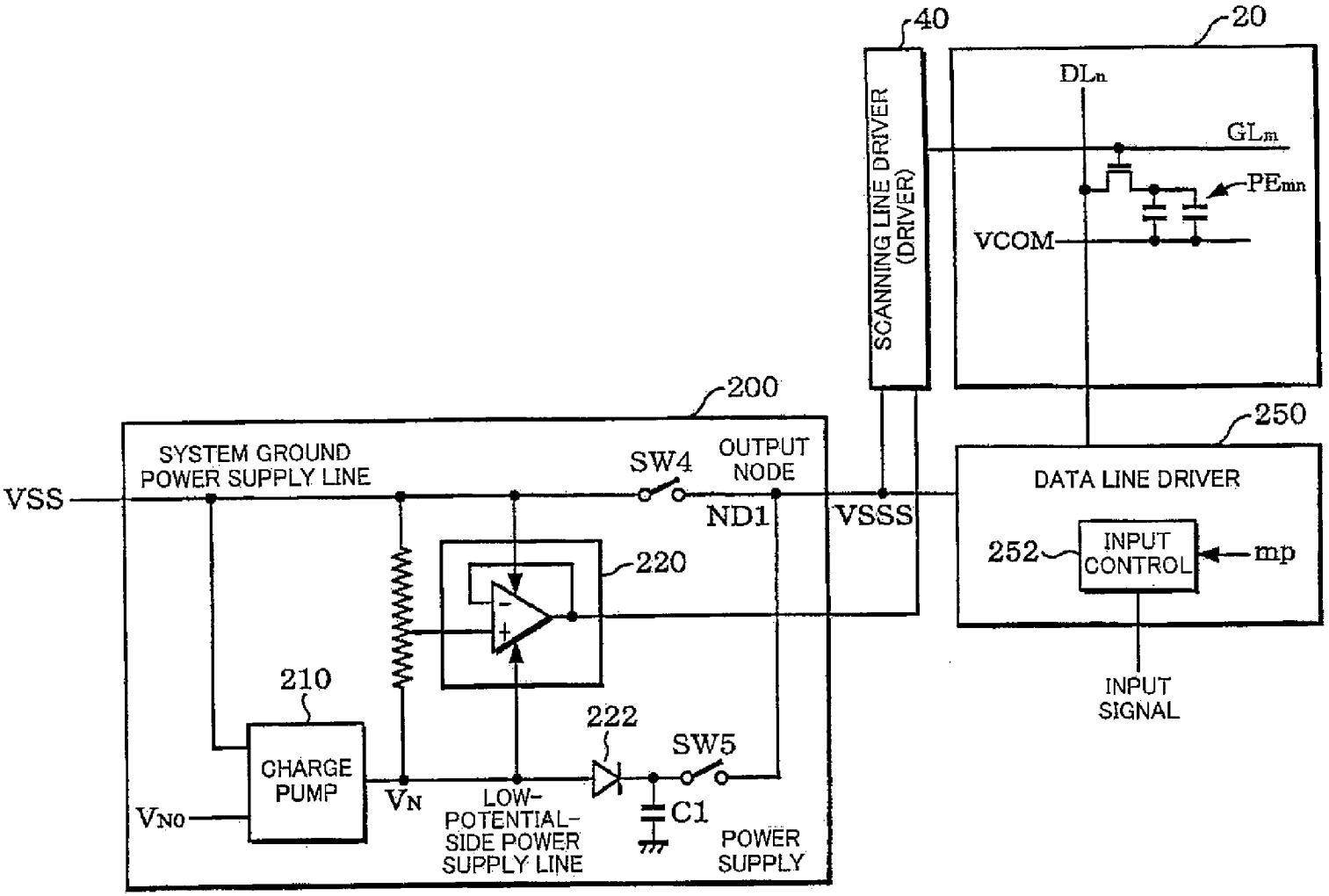
FIG. 12 is a diagram showing major portions of a power supply circuit and a data line driver circuit according to a second embodiment of the present invention.

FIG. 12 shows major portions of a power supply circuit and a data line driver circuit according to the second embodiment. Note that components corresponding to those in the liquid crystal panel 20 and the scanning line driver circuit 40 of FIG. 1 are denoted by the same reference numbers and further description thereof is omitted. A data line driver circuit 250 includes the components of the data line driver circuit 30 shown in FIG. 3.

A power supply circuit 200 in the second embodiment outputs a voltage which is negative with respect to the ground power supply potential (negative voltage) to the scanning line driver circuit 40. Therefore, the power supply circuit 200 includes a charge pump 210 and a regulator 220.

The charge pump 210 generates a negative voltage $V_N$ by increasing a given reference voltage $V_{N0}$, which is positive with respect to the ground power supply potential, in the negative direction based on a charge pump clock signal (not shown).

The operating power voltage of the regulator 220 is the potential difference between the high-potential power line and the low-potential power line. The high-potential power line of the regulator 220 is the system ground power line. The low-potential power line of the regulator 220 is a signal line to which the negative voltage $V_N$ which is the output voltage of the charge pump 210 is supplied. A given divided voltage obtained by dividing the voltage between the high-potential power line and the low-potential power line is input to the regulator 220. The regulator 220 outputs a voltage obtained by regulating the input voltage to the scanning line driver circuit 40.

The power supply circuit 200 includes fourth and fifth switching circuits SW4 and SW5. The fourth switching circuit SW4 is inserted between the low-potential power line to which the low-potential drive power voltage VSSS of the data line driver circuit 250 and the scanning line driver circuit 40 is supplied and the ground power line to which the system ground power voltage VSS is supplied. The fifth switching circuit SW5 is inserted between the low-potential power line connected with the data line driver circuit 250 and the scanning line driver circuit 40 and one end of the diode device (specific device) 222. The other end of the diode device 222 is connected with the low-potential power line of the regulator 220 (output of the charge pump 210). The diode device 222 is connected so that the direction from the low-potential power line of the regulator 220 to the fifth switching circuit SW5 is the forward direction. This allows a voltage approximately equal to the voltage of the low-potential power line of the regulator 220 to be supplied to one end of the capacitor C1.

The fourth switching circuit SW4 is ON/OFF controlled by a SW4 control signal. The fifth switching circuit SW5 is ON/OFF controlled by a SW5 control signal.

In the second embodiment, the output of the output circuit of the data line driver circuit 250 is set at a high impedance state in a given period including the polarity reversal timing in the same manner as in the first embodiment. The voltage VCOM of the common electrode COM is changed from the "H" level to the "L" level, whereby a charge is discharged from the data line $DL_n$, and the voltage of the output signal line is decreased.

However, the charge accumulated in the output signal line flows toward the low-potential power line by the output protection circuit connected with the output terminal of the data line driver circuit 250. As a result, the low-potential drive power voltage of the data line driver circuit is decreased.

The low-potential drive power voltage of the data line driver circuit 250 is supplied through the low-potential power line connected with the power supply circuit 200. Therefore, in the power supply circuit 200 in the second embodiment, the charge discharged to the low-potential power line is accumulated by providing the switching circuits, and the accumulated charge is utilized for the low-potential-side power supply of the regulator 220 which outputs the negative voltage.

Figure 13:
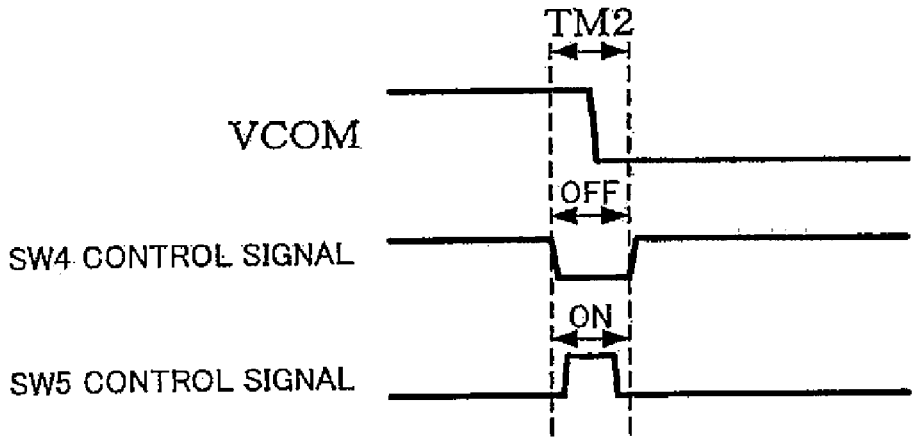
FIG. 13 is a timing chart showing a control timing of fourth and fifth switching circuits.

FIG. 13 shows an example of control timing of the fourth and fifth switching circuits SW4 and SW5. The output of the output circuit of the data line driver circuit 250 is set at a high impedance state in a period TM2 (given period) including the polarity reversal timing. In more detail, the output of the output circuit of the data line driver circuit 250 is set at a high impedance state in the period TM2 including the polarity reversal timing at which the voltage VCOM of the common electrode COM is changed from the "H" level to the "L" level. This allows the voltage of the low-potential power line of the data line driver circuit 250 to be decreased.

In the period TM2, the fourth switching circuit SW4 is turned OFF by the SW4 control signal, and the fifth switching circuit SW5 is turned ON by the SW5 control signal. This allows the low-potential power line to be electrically connected with the capacitor C1. Therefore, the charge on the low-potential power line is accumulated in the capacitor C1.

After the period TM2 has elapsed, the fourth switching circuit SW4 is turned ON by the SW4 control signal, and the fifth switching circuit SW5 is turned OFF by the SW5 control signal. This allows the voltage generated by the capacitor C1 to be applied to the low-potential power line of the regulator 220.

The period may include at least one of a specific period before the polarity reversal timing and a specific period after the polarity reversal timing.

This enables power consumption to be reduced by reutilizing the charge which is originally discarded to the ground side by the polarity reverse drive.

The power supply circuit 200 may have a configuration in which the capacitor C1 and the diode device 222 are omitted and the fifth switching circuit SW5 is connected between the low-potential power line connected with the scanning line driver circuit 40 and the data line driver circuit 250 and the low-potential power line of the regulator 220. In this case, a charge discharged to the low-potential power line is accumulated in a parasitic capacitor of the low-potential power line of the regulator 220.

In the case where the data line driver circuit 250 is formed by using a triple-well structure, a voltage which is more negative than the ground power supply potential can be generated. Therefore, the charge can be reutilized by using the above-described structure.

However, in the case where the data line driver circuit 250 is formed by using a twin-well structure, a voltage which is more negative than the ground power supply potential cannot be generated. Therefore, in the case where the signal input to the data line driver circuit 250 from the outside is at a logic level "L", the logic level recognized in the data line driver circuit 250 may differ. Therefore, the data line driver circuit 250 includes an input control circuit 252.

Figure 14:
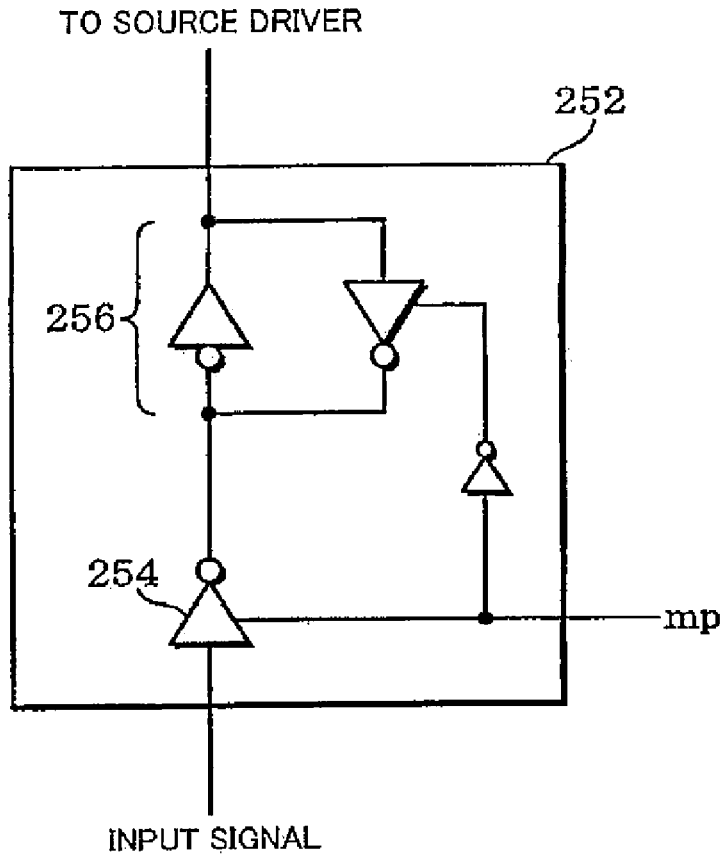
FIG. 14 is a circuit diagram of an input control circuit.

FIG. 14 shows the configuration of the input control circuit 252.

The input control circuit 252 includes a buffer circuit 254 and a latch circuit 256. The buffer circuit 254 is enabled or disabled by a negative-precharge signal mp. The latch circuit 256 is enabled or disabled by a reverse signal of the negative-precharge signal mp. The negative-precharge signal mp is a signal which is changed at the same timing as the SW4 control signal shown in FIG. 13. Therefore, since the buffer circuit 254 to which the input signal is input is set to a disabled state in the period TM2 in which the voltage VCOM is changed, the input signal is not accepted. This eliminates the case where the logic level of the input signal is incorrectly recognized.

It is preferable that the signal latched by the latch circuit 256 in response to the negative-precharge signal mp be output while being fixed at the ground power voltage of the data line driver circuit. This is because a problem relating to a withstand voltage occurs if the signal is fixed at the high-potential-side power voltage of the data line driver circuit.

Since the polarity reversal timing is recognized in the controller 50 in advance, it is preferable that the controller 50 suspend the output of the control signal to the data line driver circuit 30, the scanning line driver circuit 40, and the power supply circuit 60, and fix its output at the system ground power voltage (low-potential-side power voltage of the controller).

It is also possible to provide input signals which are differentially operated without providing the input control circuit 252.

2. Other Modifications

In recent years, there has been a demand for reduction of the size and weight of an information instrument and an increase in the image quality. Therefore, reduction of the size of the display panel and reduction of the pixel size have been demanded. As one solution to satisfy such a demand, a method of forming a display panel by using a low temperature poly-silicon (hereinafter abbreviated as "LTPS") process has been studied.

According to the LTPS process, a driver circuit and the like can be directly formed on a panel substrate (glass substrate, for example) on which pixels including a switching element (thin film transistor (TFT), for example) and the like are formed. This enables the number of parts to be decreased, whereby the size and weight of the display panel can be reduced. Moreover, LTPS enables the pixel size to be reduced by applying a conventional silicon process technology while maintaining the aperture ratio. Furthermore, LTPS has high charge mobility and small parasitic capacitance in comparison with amorphous silicon (a-Si). Therefore, a charging period for the pixel formed on the substrate can be secured even if the pixel select period per pixel is reduced due to an increase in the screen size, whereby the image quality can be improved.

The above-described embodiment may also be applied to a display panel (liquid crystal panel) formed by using the LTPS process.

Figure 15:
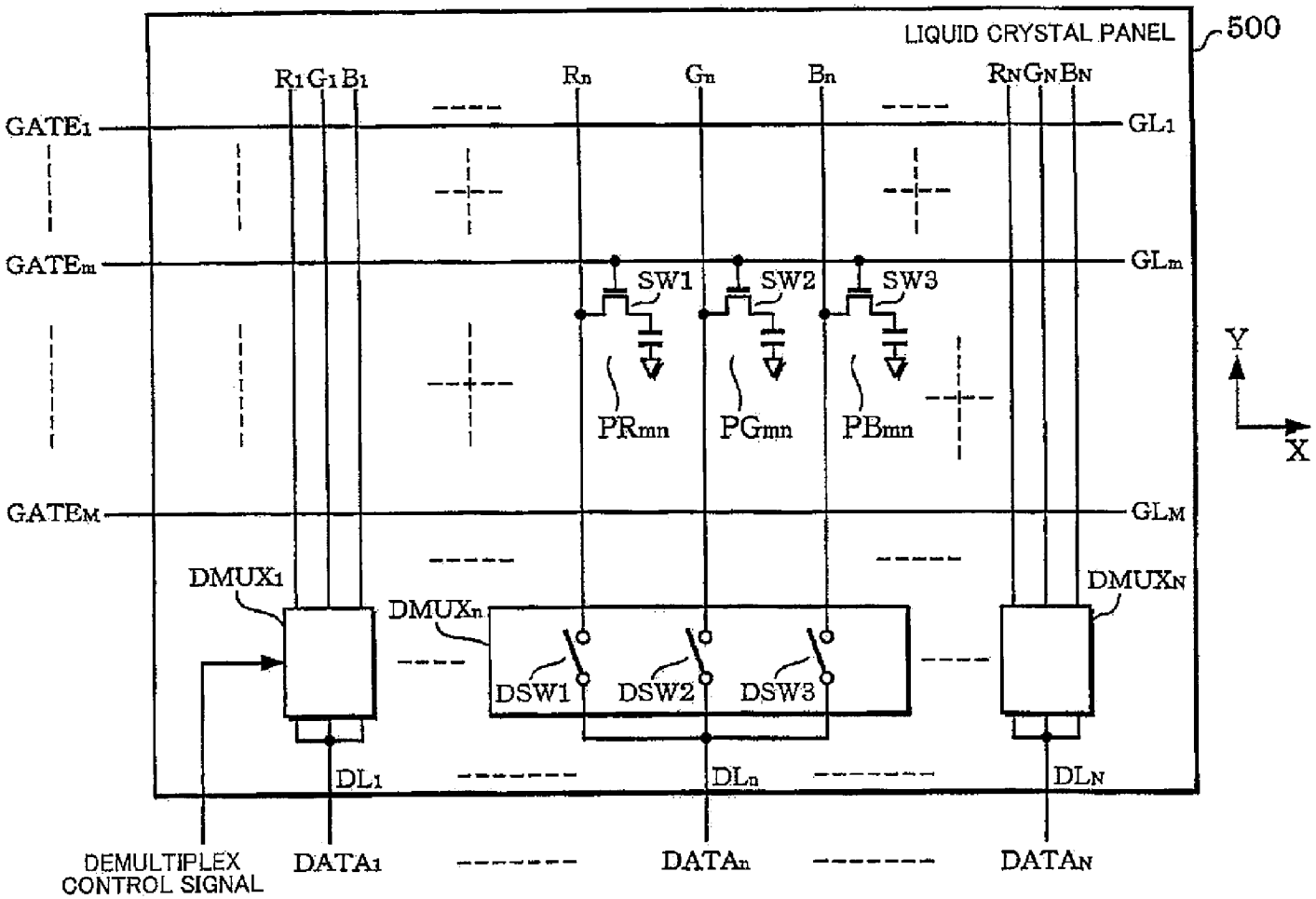
FIG. 15 is a diagram schematically showing the configuration of a liquid crystal panel formed by the LTPS process.

FIG. 15 schematically shows the configuration of a display panel formed by the LTPS process. A liquid crystal panel 500 formed by using the LTPS process includes a plurality of scanning lines, a plurality of data lines, and a plurality of pixels. The scanning lines and the data lines are disposed to intersect. A pixel is specified by the scanning line and the data line.

In the liquid crystal panel 500, the pixels are selected by each of the scanning lines (GL) and each of the data lines (DL) in units of three pixels. A signal for each color component transmitted through one of three color component data lines (R, G, B) corresponding to the data line is written in each selected pixel. Each of the pixels includes a TFT and a pixel electrode.

In the liquid crystal panel 500, the scanning lines and the data lines are formed on a panel substrate such as a glass substrate. In more detail, a plurality of scanning lines $GL_1$ to $GL_M$ which are arranged in the Y direction and extend in the X direction, and a plurality of data lines $DL_1$ to $DL_N$ which are arranged in the X direction and extend in the Y direction are disposed on the panel substrate shown in FIG. 15. First to third color component data lines ($R_1$, $G_1$, $B_1$) to ($R_N$, $G_N$, $B_N$) (first to third color component data lines make a set) which are arranged in the X direction and extend in the Y direction are formed on the panel substrate.

R pixels (first color component pixels) PR ($PR_{11}$ to $PR_{MN}$) are formed at intersecting points of the scanning lines $GL_1$ to $GL_M$ and the first color component data lines $R_1$ to $R_N$. G pixels (second color component pixels) PG ($PG_{11}$ to $PG_{MN}$) are formed at intersecting points of the scanning lines $GL_1$ to $GL_M$ and the second color component data lines $G_1$ to $G_N$. B pixels (third color component pixels) PB ($PB_{11}$ to $PB_{MN}$) are formed at intersecting points of the scanning lines $GL_1$ to $GL_M$ and the third color component data lines $B_1$ to $B_N$.

The R pixel PR, the G pixel PG, and the B pixel PB have the same configuration as that of the pixel $PE_{mn}$ shown in FIG. 1. Therefore, further description is omitted.

In FIG. 15, demultiplexers $DMUX_1$ to $DMUX_N$ provided corresponding to each of the data lines are formed on the panel substrate. A demultiplex control signal is input to the demultiplexers $DMUX_1$ to $DMUX_N$. The demultiplex control signal is a signal for controlling switching of each of the demultiplexers.

The gate signals $GATE_1$ to $GATE_M$ are respectively output to the scanning lines $GL_1$ to $GL_M$. The gate signals $GATE_1$ to $GATE_M$ are pulse signals. One of the gate signals $GATE_1$ to $GATE_M$ goes active in one frame of a vertical scanning period started by a start pulse signal.

The demultiplex control signal is supplied from the data line driver circuit in the above-described embodiment, for example. The data lines $DL_1$ to $DL_N$ are driven by the data line driver circuit in the above-described embodiment. The data line driver circuit outputs voltages (data signals) which are time-divided in units of color component pixels and correspond to the gray-scale data for each color component to each color component data line. The data line driver circuit generates the demultiplex control signal for selectively outputting the voltages corresponding to the gray-scale data for each color component to each color component data line in synchronization with the time-division timing, and outputs the demultiplex control signal to the liquid crystal panel 500.

Figure 16:
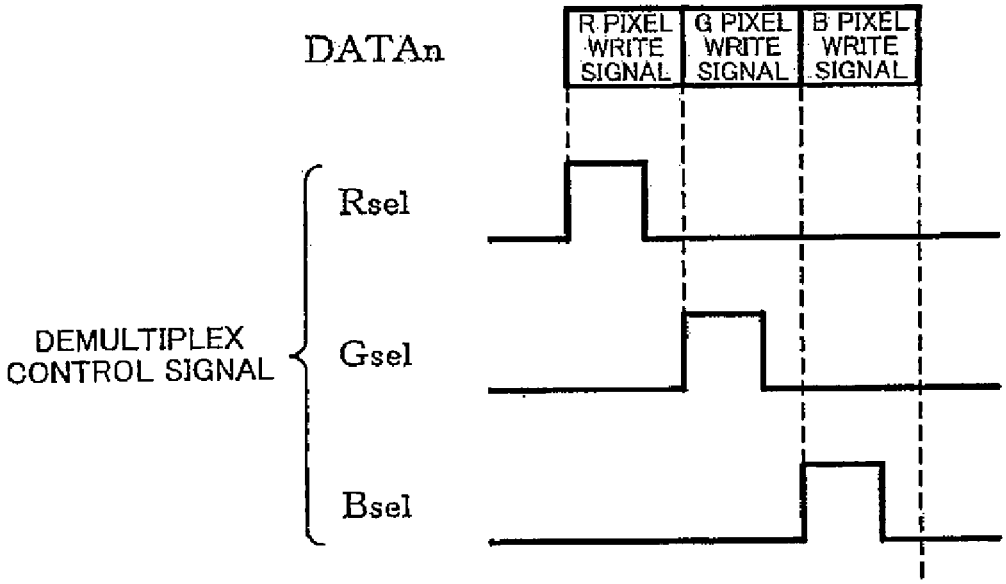
FIG. 16 is a diagram schematically showing the relationship between a data signal output to a data line from a data line driver circuit and a demultiplex control signal.

FIG. 16 schematically shows the relationship between the data signal output to the data line from the data line driver circuit and the demultiplex control signal. The data signal $DATA_1$ output to the data line $DL_n$ is shown in this figure.

The data line driver circuit outputs the data signal in which the voltages corresponding to the gray-scale data (display data) for each color component are time-division multiplexed to each data line. In FIG. 16, the data line driver circuit multiplexes a write signal to the R pixel, a write signal to the G pixel, and a write signal to the B pixel and outputs the multiplexed signal to the data line $DL_n$. The write signal to the R pixel is a write signal to the R pixel $PR_{mn}$ selected by the scanning line $GL_m$ from the R pixels $PR_{1n}$ to $PR_{Mn}$ corresponding to the data line $DL_n$, for example. The write signal to the G pixel is a write signal to the G pixel $PG_{mn}$ selected by the scanning line $GL_m$ from the G pixels $PG_{1n}$ to $PG_{Mn}$ corresponding to the data line $DL_n$, for example. The write signal to the B pixel is a write signal to the B pixel $PB_{mn}$ selected by the scanning line $GL_m$ from the B pixels $PB_{1n}$ to $PB_{Mn}$ corresponding to the data line $DL_n$, for example.

The data line driver circuit generates the demultiplex control signal in synchronization with the time-division timing of the write signals for each color component which are multiplexed into the data signal $DATA_n$. The demultiplex control signal includes first to third demultiplex control signals (Rsel, Gsel, Bsel).

The demultiplexer $DMUX_n$ corresponding to the data line $DL_n$ is formed on the panel substrate. The demultiplexer $DMUX_n$ includes first to third demultiplexing switch elements DSW1 to DSW3.

The first to third color component data lines ($R_n$, $G_n$, $B_n$) are connected with the output side of the demultiplexer $DMUX_n$. The data line $DL_n$ is connected with the input side of the demultiplexer $DMUX_n$. The demultiplexer $DMUX_n$ electrically connects the data line $DL_n$ with one of the first to third color component data lines ($R_n$, $G_n$, $B_n$) in response to the demultiplex control signal. The demultiplex control signal is input in common to the demultiplexers $DMUX_1$ to $DMUX_N$.

The first demultiplexing switch element DSW1 is ON/OFF controlled by the first demultiplex control signal Rsel. The second demultiplexing switch element DSW2 is ON/OFF controlled by the second demultiplex control signal Gsel. The third demultiplexing switch element DSW3 is ON/OFF controlled by the third demultiplex control signal Bsel. The first to third demultiplex control signals (Rsel, Gsel, Bsel) periodically and consecutively go active. Therefore, the demultiplexer $DMUX_n$ periodically and consecutively connects the data line $DL_n$ electrically with the first to third color component data lines ($R_n$, $G_n$, $B_n$).

In the liquid crystal panel 500 having such a configuration, the time-divided voltages corresponding to the gray-scale data for the first to third color components are output to the data line $DL_n$. In the demultiplexer $DMUX_n$, the voltages corresponding to the gray-scale data for each color component are applied to the first to third color component data lines ($R_n$, $G_n$, $B_n$) by the first to third demultiplex control signals (Rsel, Gsel, Bsel) generated in synchronization with the time-division timing. The color component data line is electrically connected with the pixel electrode in one of the first to third color component pixels ($PR_{mn}$, $PG_{mn}$, $PB_{mn}$) selected by the scanning line $GL_m$.

The power supply circuit in the first or second embodiment may also be applied to the liquid crystal panel 500 having the above-described configuration.

Figure 17:
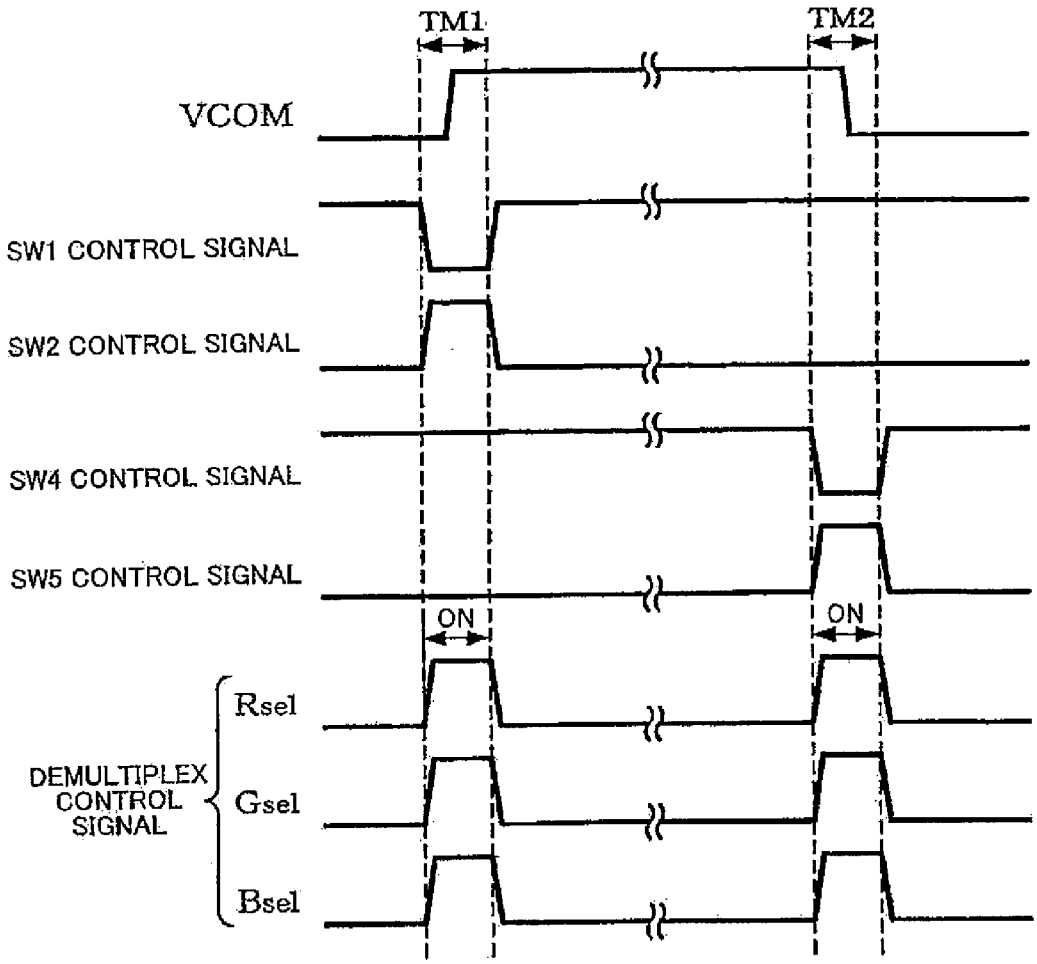
FIG. 17 is a timing chart showing a control timing when the power supply circuit according to the first or second embodiment is applied to a liquid crystal panel formed by the LTPS process.

FIG. 17 shows an example of control timing when the power supply circuit according to the first or second embodiment is applied to the liquid crystal panel 500. Storage of a charge discharged to the high-potential power line as shown in FIG. 7 or 11, and a charge discharged to the low-potential power line as shown in FIG. 12 is shown in this figure.

The first to third demultiplex control signals (Rsel, Gsel, Bsel) are turned ON at the same time in the periods TM1 and TM2 including the polarity reversal timing.

In more detail, the first to third color component data lines ($R_n$, $G_n$, $B_n$) are electrically connected with the data line $DL_n$ in the period TM1 including the polarity reversal timing at which the voltage VCOM of the common electrode COM is changed from the "L" level to the "H" level and the period TM2 including the polarity reversal timing at which the voltage VCOM is changed from the "H" level to the "L" level. Therefore, the charge accumulated in the first to third color component data lines ($R_n$, $G_n$, $B_n$) and the data line $DL_n$ is discharged in the periods TM1 and TM2.

The first to third demultiplexing switch elements DSW1 to DSW3 of all the demultiplexers $DMUX_1$ to $DMUX_N$ may be turned ON at the same time by the first to third demultiplex control signals (Rsel, Gsel, Bsel). The first to third demultiplexing switch elements DSW1 to DSW3 of only the demultiplexer of which the data line is set at a high impedance state may be turned ON at the same time.

The present invention is not limited to the above-described embodiment. Various modifications and variations are possible within the spirit and scope of the present invention.

Part of requirements of any claim of the present invention could be omitted from a dependent claim which depends on that claim. Moreover, part of requirements of any independent claim of the present invention could be made to depend on any other independent The following is disclosed relating to the above-described embodiments.

According to one embodiment of the present invention, there is provided a power supply method of supplying a high-potential drive power voltage to a driver circuit which receives a low-potential drive power voltage in addition to the high-potential drive power voltage and drives a plurality of data lines in a display panel which has a plurality of pixels and a plurality of scanning lines in addition to the data lines, the method comprising:

setting an output from the driver circuit to the data lines to a high-impedance state, and accumulating a charge corresponding to a charge discharged from the data lines in a parasitic capacitor of a power line of a regulator which outputs a drive power voltage to be supplied to the driver circuit, within a given period; and outputting a voltage generated by the charge accumulated in the parasitic capacitor to the power line, and supplying a voltage generated by the regulator to the driver circuit as the high-potential drive power voltage for the driver circuit, after the period.

A charge discharged from the data lines is a charge flowing from the data lines of the display panel when the polarity inversion drive is performed, for example.

In this power supply method, the output of the driver circuit to the data line is set at a high impedance state, and the charge discharged from the data line which is originally discarded to the system ground power line by the regulator which outputs the high-potential drive power voltage of the driver circuit is accumulated in the parasitic capacitor of the power line of the regulator. The voltage generated by the charge accumulated in the parasitic capacitor is output to the power line of the regulator after accumulating the charge in the parasitic capacitor, and the high-potential drive power voltage is supplied to the driver circuit.

Therefore, since the high-potential drive power voltage of the driver circuit can be supplied by reutilizing the charge which is originally discarded, power consumption can be reduced.

According to one embodiment of the present invention, there is provided a power supply method of supplying a high-potential drive power voltage to a driver circuit which receives a low-potential drive power voltage in addition to the high-potential drive power voltage and drives a plurality of data lines in a display panel which has a plurality of pixels and a plurality of scanning lines in addition to the data lines, the method comprising:

setting an output from the driver circuit to the data lines to a high-impedance state, and accumulating a charge corresponding to a charge discharged from the data lines in a capacitor, one end of which is connected directly or through a specific component to a power line of a regulator which outputs a drive power voltage to be supplied to the driver circuit, within a given period; and outputting a voltage generated by the charge accumulated in the capacitor to the power line, and supplying a voltage generated by the regulator to the driver circuit as the high-potential drive power voltage for the driver circuit, after the period.

As the specific device, a diode or a switching element can be given, for example.

In this power supply method, the output of the driver circuit to the data line is set at a high impedance state, and the charge discharged from the data line which is originally discarded to the system ground power line by the regulator which outputs the high-potential drive power voltage of the driver circuit is accumulated in the capacitor which is connected on one end either directly or through the specific device with the power line of the regulator. Therefore, the capacitor can accumulate the charge discharged from the data line on the other end. The voltage generated by the charge accumulated in the capacitor (voltage generated across each end of the capacitor) is output to the power line of the regulator after accumulating the charge in the capacitor, and the high-potential drive power voltage is supplied to the driver circuit.

Therefore, since the high-potential drive power voltage of the driver circuit can be supplied by reutilizing the charge which is originally discarded, power consumption can be reduced.

According to one embodiment of the present invention, there is provided a power supply method of supplying a high-potential drive power voltage to a driver circuit which receives a low-potential drive power voltage in addition to the high-potential drive power voltage and drives a plurality of data lines in a display panel which has in addition to the data lines through each of which multiplexed data signals for first to third color components are transmitted:

a plurality of scanning lines;

a plurality of pixels, each of which is connected to one of the scanning lines and one of the data lines; and a plurality of demultiplexers, each of which includes first to third demultiplexing switch elements respectively controlled by first to third demultiplex control signals, one end of each of the demultiplexing switch elements being connected to one of the data lines, and the other end of each of the demultiplexing switch elements being connected to a pixels for the j-th color component ($1 \leqq j \leqq 3$, j is an integer) among the pixels, the method comprising:

setting an output from the driver circuit to the data lines to a high-impedance state, setting the first to third demultiplexing switch elements to an ON state by using the first to third demultiplex control signals, and accumulating a charge corresponding to a charge discharged from the data lines in a parasitic capacitor of a power line of a regulator which outputs a drive power voltage to be supplied to the driver circuit, within a given period; and outputting a voltage generated by the charge accumulated in the parasitic capacitor to the power line, and supplying a voltage generated by the regulator to the driver circuit as the high-potential drive power voltage for the driver circuit, after the period.

Setting the f-th demultiplexing switch element ($1 \leqq f \leqq 3$, f is an integer) to an ON state means closing the f-th demultiplexing switch element. Specifically, the pixel for the j-th color component and the data line on each end of the f-th demultiplexing switch element are electrically connected.

This power supply method may be applied for providing a power supply to a driver circuit which drives a display panel formed by using a low temperature poly-silicon (LTPS) process, for example.

In this power supply method, the output of the driver circuit to the data line is set at a high impedance state, and the charge discharged from the data line which is originally discarded to the system ground power line by the regulator which outputs the high-potential drive power voltage of the driver circuit is accumulated in the parasitic capacitor of the power line of the regulator. The charge to be discharged from the data line connected with the first to third color component pixels is discharged by setting all of the first to third demultiplexing switch elements included in each of the demultiplexers of the display panel to an ON state.

The voltage generated by the charge accumulated in the parasitic capacitor is output to the power line of the regulator after accumulating the charge in the parasitic capacitor, and the high-potential drive power voltage is supplied to the driver circuit.

Therefore, since the high-potential drive power voltage of the driver circuit can also be supplied to the display panel formed by using the LTPS process by reutilizing the charge which is originally discarded, power consumption can be reduced.

According to one embodiment of the present invention, there is provided a power supply method of supplying a high-potential drive power voltage to a driver circuit which receives a low-potential drive power voltage in addition to the high-potential drive power voltage and drives a plurality of data lines in a display panel which has in addition to the data lines through each of which multiplexed data signals for first to third color components are transmitted:

a plurality of scanning lines;

a plurality of pixels, each of which is connected to one of the scanning lines and one of the data lines; and a plurality of demultiplexers, each of which includes first to third demultiplexing switch elements respectively controlled by first to third demultiplex control signals, one end of each of the demultiplexing switch elements being connected to one of the data lines, and the other end of each of the demultiplexing switch elements being connected to a pixels for the j-th color component ($1 \leqq j \leqq 3$, j is an integer) among the pixels, the method comprising:

setting an output from the driver circuit to the data lines to a high-impedance state, setting the first to third demultiplexing switch elements to an ON state by using the first to third demultiplex control signals, and accumulating a charge corresponding to a charge discharged from the data lines in a capacitor, one end of which is connected directly or through a specific component to a power line of a regulator which outputs a drive power voltage to be supplied to the driver circuit, within a given period; and outputting a voltage generated by the charge accumulated in the capacitor to the power line, and supplying a voltage generated by the regulator to the driver circuit as the high-potential drive power voltage for the driver circuit, after the period.

This power supply method may be applied for providing a power supply to a driver circuit which drives a display panel formed by using the LTPS process, for example.

In this power supply method, the output of the driver circuit to the data line is set at a high impedance state, and the charge discharged from the data line which is originally discarded to the system ground power line by the regulator which outputs the high-potential drive power voltage of the driver circuit is accumulated in the capacitor which is connected on one end either directly or through the specific device with the power line of the regulator. Therefore, the capacitor can accumulate the charge discharged from the data line on the other end. The charge to be discharged from the data line connected with the first to third color component pixel is discharged by setting all of the first to third demultiplexing switch elements included in each of the demultiplexers of the display panel to an ON state.

The voltage generated by the charge accumulated in the capacitor (voltage generated across each end of the capacitor) is output to the power line of the regulator after accumulating the charge in the capacitor, and the high-potential drive power voltage is supplied to the driver circuit.

Therefore, since the high-potential drive power voltage of the driver circuit can also be supplied to the display panel formed by using the LTPS process by reutilizing the charge which is originally discarded, power consumption can be reduced.

In the above power supply method, polarity of a voltage between a pixel electrode of each of the pixels connected to one of the data lines and a common electrode facing the pixel electrode through an electro-optical material may be reversed during the period.

Since the charge discarded accompanying the polarity reverse drive can be reutilized, display quality can be improved by the polarity reverse drive and power consumption can be reduced.

According to one embodiment of the present invention, there is provided a power supply method of supplying a negative voltage to a driver circuit which receives high-potential and low-potential drive power voltages and drives a plurality of data lines in a display panel which has a plurality of pixels and a plurality of scanning lines in addition to the data lines, by utilizing a charge from a low-potential power line through which the low-potential drive power voltage is supplied, the method comprising:

setting an output from the driver circuit to the data lines to a high-impedance state, and accumulating a charge corresponding to a charge discharged from the data lines in a parasitic capacitor of the low-potential power line connected to a regulator which outputs the negative voltage, within a given period; and outputting the negative voltage generated by the regulator based on a voltage generated by the charge accumulated in the parasitic capacitor, as the low-potential drive power voltage, after the period.

The negative voltage may be supplied to a driver circuit which drives the scanning lines, for example.

In this power supply method, the output of the driver circuit to the data line is set at a high impedance state, and the charge discharged from the data line which is originally discarded to the low-potential power line of the data line driver circuit is accumulated in the parasitic capacitor of the low-potential power line of the regulator which outputs the negative voltage. The negative voltage is output by supplying the voltage generated by the charge accumulated in the parasitic capacitor to the low-potential power line of the regulator after accumulating the charge in the parasitic capacitor.

Therefore, since the negative voltage can be generated by reutilizing the charge which is originally discarded, power consumption can be reduced.

According to one embodiment of the present invention, there is provided a power supply method of supplying a negative voltage to a driver circuit which receives high-potential and low-potential drive power voltages and drives a plurality of data lines in a display panel which has a plurality of pixels and a plurality of scanning lines in addition to the data lines, by utilizing a charge from a low-potential power line through which the low-potential drive power voltage is supplied, the method comprising:

setting an output from the driver circuit to the data lines to a high-impedance state, and accumulating a charge corresponding to a charge discharged from the data lines in a capacitor, one end of which is connected directly or through a specific component to the low-potential power line connected to a regulator which outputs the negative voltage, within a given period; and outputting the negative voltage generated by the regulator based on a voltage generated by the charge accumulated in the capacitor, as the low-potential drive power voltage, after the period.

In this power supply method, the output of the driver circuit to the data line is set at a high impedance state, and the charge discharged from the data line which is originally discarded to the low-potential power line of the data line driver circuit is accumulated on the other end of the capacitor which is connected on one end either directly or through the specific device with the low-potential power line of the regulator which outputs the negative voltage.

The negative voltage is output by supplying the voltage generated by the charge accumulated in the capacitor to the low-potential power line of the regulator after accumulating the charge in the parasitic capacitor.

Therefore, since the negative voltage can be generated by reutilizing the charge which is originally discarded, power consumption can be reduced.

According to one embodiment of the present invention, there is provided a power supply method of supplying a negative voltage by utilizing a charge from a low-potential power line through which a low-potential drive power voltage is supplied, to a driver circuit which receives a high-potential drive power voltage in addition to the low-potential drive power voltage and drives a plurality of data lines in a display panel which has in addition to the data lines through each of which multiplexed data signals for first to third color components are transmitted:

a plurality of scanning lines;

a plurality of pixels, each of which is connected to one of the scanning lines and one of the data lines; and a plurality of demultiplexers, each of which includes first to third demultiplexing switch elements respectively controlled by first to third demultiplex control signals, one end of each of the demultiplexing switch elements being connected to one of the data lines, and the other end of each of the demultiplexing switch elements being connected to a pixels for the j-th color component ($1 \leqq j \leqq 3$, j is an integer) among the pixels, the method comprising:

setting an output from the driver circuit to the data lines to a high-impedance state, setting the first to third demultiplexing switch elements to an ON state by using the first to third demultiplex control signals, and accumulating a charge corresponding to a charge discharged from the data lines in a parasitic capacitor of the low-potential power line connected to a regulator which outputs the negative voltage, within a given period; and outputting the negative voltage generated by the regulator based on a voltage generated by the charge accumulated in the parasitic capacitor, as the low-potential drive power voltage, after the period.

According to one embodiment of the present invention, there is provided a power supply method of supplying a negative voltage by utilizing a charge from a low-potential power line through which a low-potential drive power voltage is supplied, to a driver circuit which receives a high-potential drive power voltage in addition to the low-potential drive power voltage and drives a plurality of data lines in a display panel which has in addition to the data lines through each of which multiplexed data signals for first to third color components are transmitted:

a plurality of scanning lines;

a plurality of pixels, each of which is connected to one of the scanning lines and one of the data lines; and a plurality of demultiplexers, each of which includes first to third demultiplexing switch elements respectively controlled by first to third demultiplex control signals, one end of each of the demultiplexing switch elements being connected to one of the data lines, and the other end of each of the demultiplexing switch elements being connected to a pixels for the j-th color component ($1 \leqq j \leqq 3$, j is an integer) among the pixels, the method comprising:

setting an output from the driver circuit to the data lines to a high-impedance state, setting the first to third demultiplexing switch elements to an ON state by using the first to third demultiplex control signals, and accumulating a charge corresponding to a charge discharged from the data lines in a capacitor, one end of which is connected directly or through a specific component to the low-potential power line connected to a regulator which outputs the negative voltage, within a given period; and outputting the negative voltage generated by the regulator based on a voltage generated by the charge accumulated in the capacitor, as the low-potential drive power voltage, after the period.

According to the above power supply method, since the negative voltage can also be output to a display panel formed by using the LTPS process by reutilizing the charge which is originally discarded, power consumption can be reduced.

In the above power supply method, no input signal may be accepted by the driver circuit during the period.

Since the low-potential drive power voltage of the driver circuit is decreased, occurrence of a problem in which the logic level of the input signal to the driver circuit is incorrectly recognized due to the charge discharged from the data line in the above period can be prevented.

In the above power supply method, an output of an input buffer to which the input signal is input may be fixed to the low-potential drive power voltage of the driver circuit.

Leakage which occurs by fixing the input signal to the driver circuit can be prevented by fixing the output of the input buffer at the low-potential drive power voltage. Moreover, it is unnecessary to form the driver circuit by using a high voltage process.

In the above power supply method, outputting a control signal to the driver circuit from a controller which controls the driver circuit may be suspended during the period.

If the controller recognizes the period, the configuration in which the driver circuit does not accept the input signal can be made unnecessary.

In the above power supply method, an output of the control signal may be fixed to a low-potential power voltage of the controller.

Leakage of the control signal suspended by the controller can be prevented. Moreover, it is unnecessary to form the controller by using a high voltage process.

In the above power supply method, polarity of a voltage between a pixel electrode of each of the pixels connected to one of the data lines and a common electrode facing the pixel electrode through an electro-optical material may be reversed during the period.

Since the charge discarded accompanying the polarity reverse drive can be reutilized, display quality can be improved by the polarity reverse drive and power consumption can be reduced.

According to one embodiment of the present invention, there is provided a power supply circuit which supplies a high-potential drive power voltage to a driver circuit which receives a low-potential drive power voltage in addition to the high-potential drive power voltage and drives a plurality of data lines in a display panel which has a plurality of pixels and a plurality of scanning lines in addition to the data lines, the power supply circuit comprising:

a regulator which operates using a first voltage supplied to a power line of the regulator as a power voltage, and outputs a voltage obtained by regulating an input voltage which is the first voltage or a voltage obtained by dividing the first voltage;

a first switching circuit, one end of the first switching circuit being connected with an output node to which the high-potential drive power voltage of the driver circuit is output and the other end of the first switching circuit being connected with output of the regulator; and a second switching circuit, one end of the second switching circuit being connected with the output node and the other end of the second switching circuit being connected with the power line, wherein:

the first switching circuit is turned off, the second switching circuit is turned on, and a charge corresponding to a charge discharged from the data lines is accumulated in a parasitic capacitor of the power line of the regulator during a given period in which an output from the driver circuit to the data lines is set to a high impedance state, and polarity of a voltage between a pixel electrode of each of the pixels connected to one of the data lines and a common electrode facing the pixel electrode through an electro-optical material is reversed; and the first switching circuit is turned on, the second switching circuit is turned off, and the regulated voltage is output to the output node by the regulator to which a voltage generated by the charge accumulated in the parasitic capacitor is supplied as a power voltage of the regulator.

According to one embodiment of the present invention, there is provided a power supply circuit which supplies a high-potential drive power voltage to a driver circuit which receives a low-potential drive power voltage in addition to the high-potential drive power voltage and drives a plurality of data lines in a display panel which has a plurality of pixels and a plurality of scanning lines in addition to the data lines, the power supply circuit comprising:

a regulator outputs a voltage obtained by regulating an input voltage which is a first voltage or a voltage obtained by dividing the first voltage;

a first switching circuit, one end of the first switching circuit being connected with an output node to which the high-potential drive power voltage of the driver circuit is output and the other end of the first switching circuit being connected with output of the regulator; and a second switching circuit, one end of which is connected to the output node;

a capacitor, one end of the capacitor being connected to the other end of the second switching circuit, and the other end of the capacitor being connected to a system power line; and a diode connected between the other end of the second switching circuit and a power line of the regulator to which is supplied a power voltage so that a direction from the system power line to the power line of the regulator is a forward direction, wherein:

the first switching circuit is turned off, the second switching circuit is turned on, and a charge corresponding to a charge discharged from the data lines is accumulated in the capacitor during a given period in which an output from the driver circuit to the data lines is set to a high impedance state, and polarity of a voltage between a pixel electrode of each of the pixels connected to one of the data lines and a common electrode facing the pixel electrode through an electro-optical material is reversed; and the first switching circuit is turned on, the second switching circuit is turned off, and the regulated voltage is output by the regulator to which a voltage generated by the charge accumulated in the parasitic capacitor is supplied as a power voltage of the regulator.

According to one embodiment of the present invention, there is provided a power supply circuit which outputs a negative voltage to a driver circuit which receives high-potential and low-potential drive power voltages and drives a plurality of data lines in a display panel which has a plurality of pixels and a plurality of scanning lines in addition to the data lines, by utilizing a charge from a low-potential power line through which the low-potential drive power voltage is supplied, the power supply circuit comprising:

a regulator which outputs a voltage obtained by regulating a negative voltage input to the regulator;

a fourth switching circuit, one end of the fourth switching circuit being connected to an output node which outputs the low-potential drive power voltage for the driver circuit, and the other end of the fourth switching circuit being connected to a system ground power line to which a ground power voltage of the power supply circuit is supplied; and a fifth switching circuit, one end of the fifth switching circuit being connected to the output node, and the other end of the fifth switching circuit being connected to a low-potential power line of the regulator directly or through a specific device, wherein:

the fourth switching circuit is turned off, the fifth switching circuit is turned on, and a charge corresponding to a charge discharged from the data lines is accumulated in a parasitic capacitor of the low-potential power line of the regulator during a given period in which an output from the driver circuit to the data lines is set to a high impedance state, and polarity of a voltage between a pixel electrode of each of the pixels connected to one of the data lines and a common electrode facing the pixel electrode through an electro-optical material is reversed; and the fourth switching circuit is turned on, the fifth switching circuit is turned off, and a voltage generated by the charge accumulated in the parasitic capacitor is output to the low-potential power line of the regulator.

According to one embodiment of the present invention, there is provided a power supply circuit which outputs a negative voltage to a driver circuit which receives high-potential and low-potential drive power voltages and drives a plurality of data lines in a display panel which has a plurality of pixels and a plurality of scanning lines in addition to the data lines, by utilizing a charge from a low-potential power line through which the low-potential drive power voltage is supplied, the power supply circuit comprising:

a regulator which outputs a voltage obtained by regulating a negative voltage input to the regulator;

a fourth switching circuit, one end of the fourth switching circuit being connected to an output node which outputs the low-potential drive power voltage for the driver circuit, and the other end of the fourth switching circuit being connected to a system ground power line to which a ground power voltage of the power supply circuit is supplied;

a fifth switching circuit, one end of which is connected to the output node;

a capacitor, one end of the capacitor being connected to the other end of the fifth switching circuit, and the other end of the capacitor being grounded; and a diode connected between a low-potential power line of the regulator and the other end of the fifth switching circuit so that a direction from the low-potential power line of the regulator to the fifth switching circuit is a forward direction, wherein:

the fourth switching circuit is turned off, the fifth switching circuit is turned on, and a charge corresponding to a charge discharged from the data lines is accumulated in the capacitor during a given period in which an output from the driver circuit to the data lines is set to a high impedance state, and polarity of a voltage between a pixel electrode of each of the pixels connected to one of the data lines and a common electrode facing the pixel electrode through an electro-optical material is reversed; and the fourth switching circuit is turned on, the fifth switching circuit is turned off, and a voltage generated by the charge accumulated in the capacitor is output to the low-potential power line of the regulator.

What is claimed is:

1. A power supply circuit which supplies a high-potential drive power voltage to a driver circuit which receives a low-potential drive power voltage in addition to the high-potential drive power voltage and drives a plurality of data lines in a display panel which has a plurality of pixels and a plurality of scanning lines in addition to the data lines, the power supply circuit comprising:

a regulator outputs a voltage obtained by regulating an input voltage which is a first voltage or a voltage obtained by dividing the first voltage;

a first switching circuit, one end of the first switching circuit being connected with an output node to which the high-potential drive power voltage of the driver circuit is output and the other end of the first switching circuit being connected with output of the regulator; and a second switching circuit, one end of which is connected to the output node;

a capacitor, one end of the capacitor being connected to the other end of the second switching circuit, and the other end of the capacitor being connected to a system power line; and a diode connected between the other end of the second switching circuit and a power line of the regulator to which is supplied a power voltage so that a direction from the system power line to the power line of the regulator is a forward direction, wherein:

the first switching circuit is turned off, the second switching circuit is turned on, and a charge corresponding to a charge discharged from the data lines is accumulated in the capacitor during a given period in which an output from the driver circuit to the data lines is set to a high impedance state, and polarity of a voltage between a pixel electrode of each of the pixels connected to one of the data lines and a common electrode facing the pixel electrode through an electro-optical material is reversed; and the first switching circuit is turned on, the second switching circuit is turned off, and the regulated voltage is output by the regulator to which a voltage generated by the charge accumulated in the parasitic capacitor is supplied as a power voltage of the regulator.

2. A power supply method of supplying a high-potential drive power voltage to a driver circuit which receives a low-potential drive power voltage in addition to the high-potential drive power voltage and drives a plurality of data lines in a display panel which has in addition to the data lines through each of which multiplexed data signals for first to third color components are transmitted:

a plurality of scanning lines;

a plurality of pixels, each of which is connected to one of the scanning lines and one of the data lines; and a plurality of demultiplexers, each of which includes first to third demultiplexing switch elements respectively controlled by first to third demultiplex control signals, one end of each of the demultiplexing switch elements being connected to one of the data lines, and the other end of each of the demultiplexing switch elements being connected to a pixels for the j-th color component ($1<j<3$, j is an integer) among the pixels, the method comprising:

setting an output from the driver circuit to the data lines to a high-impedance state, setting the first to third demultiplexing switch elements to an ON state by using the first to third demultiplex control signals, and accumulating a charge corresponding to a charge discharged from the data lines in a capacitor, one end of which is connected directly or through a specific component to a power line of a regulator which outputs a drive power voltage to be supplied to the driver circuit, within a given period; and outputting a voltage generated by the charge accumulated in the capacitor to the power line, and supplying a voltage generated by the regulator to the driver circuit as the high-potential drive power voltage for the driver circuit, after the period.

3. The power supply method as defined in claim 2, wherein polarity of a voltage between a pixel electrode of each of the pixels connected to one of the data lines and a common electrode facing the pixel electrode through an electro-optical material is reversed during the period.

4. A power supply method of supplying a high-potential drive power voltage to a driver circuit which receives a low-potential drive power voltage in addition to the high-potential drive power voltage and drives a plurality of data lines in a display panel which has a plurality of pixels and a plurality of scanning lines in addition to the data lines, the method comprising:

setting an output from the driver circuit to the data lines to a high-impedance state, and accumulating a charge corresponding to a charge discharged from the data lines in a capacitor, one end of which is connected directly or through a specific component to a power line of a regulator which outputs a drive power voltage to be supplied to the driver circuit, within a given period; and outputting a voltage generated by the charge accumulated in the capacitor to the power line, and supplying a voltage generated by the regulator to the driver circuit as the high-potential drive power voltage for the driver circuit, after the period.

5. The power supply method as defined in claim 4, wherein polarity of a voltage between a pixel electrode of each of the pixels connected to one of the data lines and a common electrode facing the pixel electrode through an electro-optical material is reversed during the period.

* * * * *